US009274489B2

(12) United States Patent
Takarada et al.

(10) Patent No.: US 9,274,489 B2
(45) Date of Patent: Mar. 1, 2016

(54) CARTRIDGE WITH ELECTRODE MEMBER CONSTITUTING A CONDUCTING PATH

(71) Applicant: CANON KABUSHIKI KAISHA, Tokyo (JP)

(72) Inventors: Hiroshi Takarada, Tokyo (JP); Akira Suzuki, Naka-gun (JP); Yuichi Fukui, Yokosuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 144 days.

(21) Appl. No.: 13/672,059

(22) Filed: Nov. 8, 2012

(65) Prior Publication Data

US 2013/0114972 A1 May 9, 2013

(30) Foreign Application Priority Data

Nov. 9, 2011 (JP) ..... 2011-245734
Dec. 19, 2011 (JP) ..... 2011-277466

(51) Int. Cl.
*G03G 15/00* (2006.01)
*G03G 15/08* (2006.01)
*G03G 21/18* (2006.01)

(52) U.S. Cl.
CPC ..... *G03G 15/80* (2013.01); *G03G 15/0896* (2013.01); *G03G 21/181* (2013.01); *G03G 21/1867* (2013.01); *G03G 2215/0872* (2013.01)

(58) Field of Classification Search
CPC ..... G03G 21/1867; G03G 21/18; G03G 21/1652; G03G 2215/0872
USPC ..... 399/90
See application file for complete search history.

(56) References Cited

U.S. PATENT DOCUMENTS

| | | | |
|---|---|---|---|
| 5,966,567 | A | 10/1999 | Matsuzaki et al. |
| 6,144,815 | A | 11/2000 | Chadani et al. |
| 6,154,623 | A | 11/2000 | Suzuki et al. |
| 6,173,140 | B1 | 1/2001 | Suzuki et al. |
| 6,173,145 | B1 | 1/2001 | Chadani et al. |
| 6,205,305 | B1 | 3/2001 | Suzuki et al. |

(Continued)

FOREIGN PATENT DOCUMENTS

| | | |
|---|---|---|
| JP | 2000-112318 | 4/2000 |
| JP | 2007047491 | 2/2007 |

(Continued)

OTHER PUBLICATIONS

International Search Report and Written Opinion of the International Searching Authority for PCT/JP2012/079588, mailed Jan. 25, 2013.

(Continued)

*Primary Examiner* — Walter L Lindsay, Jr.
*Assistant Examiner* — Ruth Labombard
(74) *Attorney, Agent, or Firm* — Fitzpatrick, Cella, Harper & Scinto

(57) ABSTRACT

A cartridge detachably mountable to a main assembly of an image forming apparatus, includes: a member to be supplied with electric energy; a frame molded with a resin material; and an electrode member formed on the frame by injection molding of an electroconductive resin material. The electrode member includes a supporting portion for supporting the member to be supplied with electric energy and a contact portion to be contacted to a main assembly electric contact, provided in the main assembly, when the cartridge is mounted to the main assembly.

33 Claims, 33 Drawing Sheets

(56) References Cited

U.S. PATENT DOCUMENTS

| | | | |
|---|---|---|---|
| 6,219,504 | B1 | 4/2001 | Matsuzaki et al. |
| 6,246,853 | B1 | 6/2001 | Suzuki et al. |
| 6,282,389 | B1 | 8/2001 | Matsuzaki et al. |
| 6,415,121 | B1 | 7/2002 | Suzuki et al. |
| 6,549,736 | B2 | 4/2003 | Miyabe et al. |
| 6,654,578 | B2 | 11/2003 | Suzuki et al. |
| 6,771,920 | B2 | 8/2004 | Abe et al. |
| 6,795,666 | B2 | 9/2004 | Miyabe et al. |
| 6,868,243 | B2 | 3/2005 | Watanabe et al. |
| 6,931,226 | B2 | 8/2005 | Chadani et al. |
| 6,934,485 | B2 | 8/2005 | Miyabe et al. |
| 7,099,607 | B2 | 8/2006 | Suzuki et al. |
| 7,366,439 | B2 | 4/2008 | Anan et al. |
| 7,933,534 | B2 | 4/2011 | Hoshi et al. |
| 8,155,553 | B2 | 4/2012 | Takarada |
| 8,249,485 | B2 | 8/2012 | Horikawa et al. |
| 2009/0290904 | A1 | 11/2009 | Kawai et al. |
| 2011/0170903 | A1 | 7/2011 | Hoshi et al. |
| 2013/0022368 | A1* | 1/2013 | Takarada et al. ..... 399/110 |
| 2013/0121720 | A1 | 5/2013 | Hoshi et al. |
| 2013/0129375 | A1 | 5/2013 | Yamasaki et al. |
| 2013/0129377 | A1 | 5/2013 | Satomura et al. |

FOREIGN PATENT DOCUMENTS

| | | |
|---|---|---|
| JP | 2008-292557 | 12/2008 |
| JP | 2012-063750 A | 3/2012 |

OTHER PUBLICATIONS

Office Action in Japanese Patent Application No. 2011-277466, dated Oct. 6, 2015.

* cited by examiner (a)

(b)

(a)

(b)

(a)

(b)

(a)

(b)

(a)

(b)

(a)

(b)

(c)

CARTRIDGE WITH ELECTRODE MEMBER CONSTITUTING A CONDUCTING PATH

FIELD OF THE INVENTION AND RELATED ART

The present invention relates a cartridge detachably mountable to a main assembly of an image forming apparatus.

Heretofore, in the image forming apparatus using an electrophotographic image forming process, a cartridge type in which a photosensitive drum and process means or a plurality of process means are integrally formed in a cartridge and the cartridge is detachably mountable to the image forming apparatus main assembly has been employed. In such a cartridge type, in a state in which the cartridge is mounted in the image forming apparatus main assembly, a main assembly electrode of the image forming apparatus main assembly and an electric contact portion of the cartridge are contacted, so that a member to be supplied with electric energy, such as the photosensitive drum or the process means is electrically connected to the image forming apparatus main assembly. As a result, it becomes possible to perform a process steps such as electrical charging or the like of the photosensitive drum or a developer carrying member, connection of ground connection of the photosensitive drum, remaining toner amount detection using measurement of electrostatic capacity, and the like.

Here, as an example of the electric contact portion of the cartridge, a constitution in which a metal plate 35 is assembled with a supporting member 36 for the process means as shown in FIG. 19 has been widely used. As another example, also a method in which a member molded with an electroconductive resin material is, in place of the metal plate, with the supporting member after the molding (Japanese Laid-Open Patent Application (JP-A) 2007-47491).

However, in these conventional examples, there was a need to later assemble the electric contact portion, which had already been shaped, with the supporting member of the process means (hereinafter referred to as a bearing member), so that there was a need to provide the bearing member with an inserting opening for permitting the mounting of the electric contact portion, and a hole, a cut-away portion and the like for positioning. For this reason, in order to ensure strength of peripheral members such as the bearing member, there was a need to effect an increase in (plate) thickness, reinforcement with a rib, or the like.

Further, in the case where a plurality of electric contact portions were used, there was a need to determine their layout and connecting path in consideration of creepage distance and spatial distance between the electric contact portions and therefore there was a problem that the connecting path became complicated.

Further, as the electric contact portion (electrode member) of the cartridge, the supporting member (bearing member frame) for supporting the process means and a method in which an electroconductive resin material is injected into a gap between itself and a member intimately contacted to the supporting member to be integrally molded would be considered. Further, also such a method that materials for the supporting member are integrally molded by a two-color molding by first injecting a first color resin material into a mold and then injecting an electroconductive second color resin material into the mold would be considered. However, in such a case, the supporting member for the process means and the electroconductive resin material have no affinity and therefore adhesiveness therebetween is low, so that there is a possibility that it is difficult to ensure positional accuracy necessary for product function at the electric contact portion molded with the electroconductive resin material contacted to the supporting member for the process means. For this reason, there is a possibility of generation of gap or clearance (play) between the two materials. Particularly, accuracy is required for the electric contact portion molded with the electroconductive resin material, so that when this accuracy is not satisfied, there arises a possibility that a function of the cartridge is adversely affected. Further, when impact is exerted on the process cartridge during transportation, there is a possibility of occurrences of dropping-off of the electric contact portion and floating of the electric contact portion from the supporting member.

SUMMARY OF THE INVENTION

A principal object of the present invention is to provide a cartridge including a frame for supporting a member to be supplied with electric energy which is to be electrically connected to a main assembly of an image forming apparatus, and including an electrode member for which an electroconductive path with high degree of design freedom can be simply established while ensuring strength of a frame.

Another object of the present invention is to provide a cartridge capable of further enhancing positional accuracy of the electrode member with respect to the frame and capable of preventing dropping-off of the electrode member during transportation and floating of the electrode member from the frame.

According to an aspect of the present invention, there is provided a cartridge detachably mountable to a main assembly of an image forming apparatus, comprising: a member to be supplied with electric energy; a frame molded with a resin material; and an electrode member formed on the frame by injection molding of an electroconductive resin material, wherein the electrode member includes a supporting portion for supporting the member to be supplied with electric energy and a contact portion to be contacted to a main assembly electric contact, provided in the main assembly, when the cartridge is mounted to the main assembly.

According to another aspect of the present invention, there is provided an image forming apparatus for forming an image on a recording material, comprising: (i) a main assembly electric contact; (ii) a cartridge including a member to be supplied with electric energy; a frame molded with a resin material; and an electrode member formed on the frame by injection molding of an electroconductive resin material, wherein the electrode member includes a supporting portion for supporting the member to be supplied with electric energy and a contact portion to be contacted to a main assembly electric contact, provided in the main assembly, when the cartridge is mounted to a main assembly of the image forming apparatus; and (iii) conveying means for conveying the recording material.

According to another aspect of the present invention, there is provided a cartridge detachably mountable to a main assembly of an image forming apparatus, comprising: a member to be supplied with electric energy; a frame molded with a resin material and provided with a through hole; and an electrode member formed on the frame by injection molding of an electroconductive resin material, and constituting a conducting path between the main assembly and the member to be supplied with electric energy when the cartridge is mounted to the main assembly, wherein the electrode member includes a penetrating portion for penetrating through a through hole, a supporting portion which is provided in one end side of the penetrating portion with respect to an arrow direction of the penetrating portion and which is configured to rotatably support the member to be supplied with electric energy, and an engaging portion which is provided in another end side of the penetrating portion with respect to the arrow direction and which extends in a direction crossing the arrow direction, and wherein the electrode member is prevented from moving in the arrow direction relative to the frame by the supporting portion and the engaging portion.

According to a further aspect of the present invention, there is provided an image forming apparatus for forming an image on a recording material, comprising: (i) a main assembly electric contact; (ii) a cartridge including a member to be supplied with electric energy; a frame molded with a resin material; and an electrode member formed on the frame by injection molding of an electroconductive resin material, and constituting a conducting path between the main assembly electric contact and the member to be supplied with electric energy when the cartridge is mounted to a main assembly of the image forming apparatus, wherein the electrode member includes a penetrating portion for penetrating through a through hole, a supporting portion which is provided in one end side of the penetrating portion with respect to an arrow direction of the penetrating portion and which is configured to rotatably support the member to be supplied with electric energy, and an engaging portion which is provided in another end side of the penetrating portion with respect to the arrow direction and which extends in a direction crossing the arrow direction, and wherein the electrode member is prevented from moving in the arrow direction relative to the frame by the supporting portion and the engaging portion; and (iii) conveying means for conveying the recording material.

BRIEF DESCRIPTION OF THE DRAWINGS

Parts (a), (b) and (c) of FIG. 1 are schematic views for illustrating progression after an electroconductive resin material is injected for forming a contact portion in Embodiment 1.

Parts (a) and (b) of FIG. 2 are schematic sectional views of an image forming apparatus and a process cartridge, respectively, in Embodiment 1.

Figure 3:
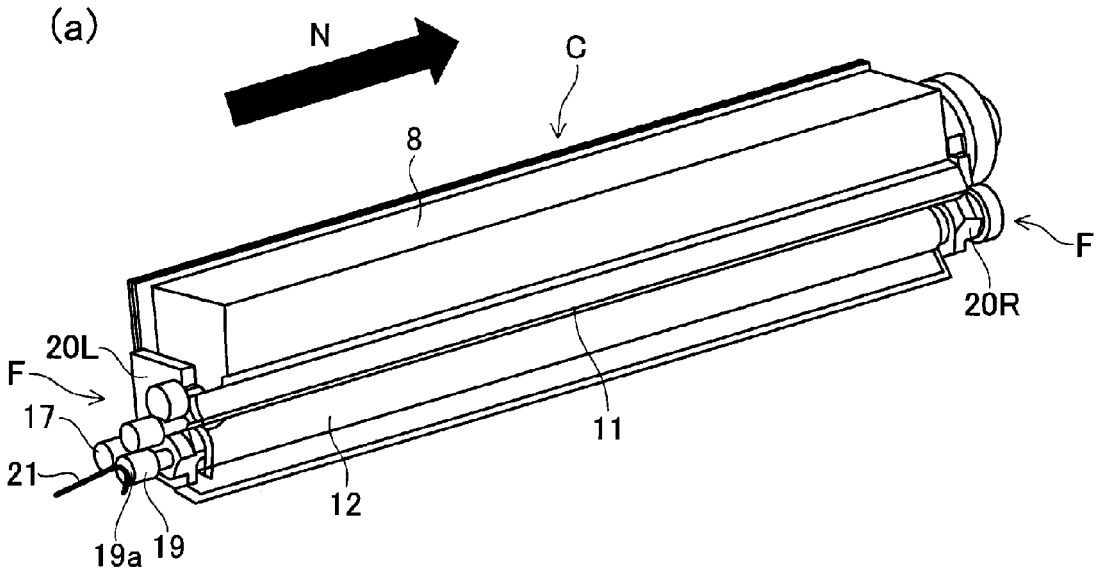
Figure 3:
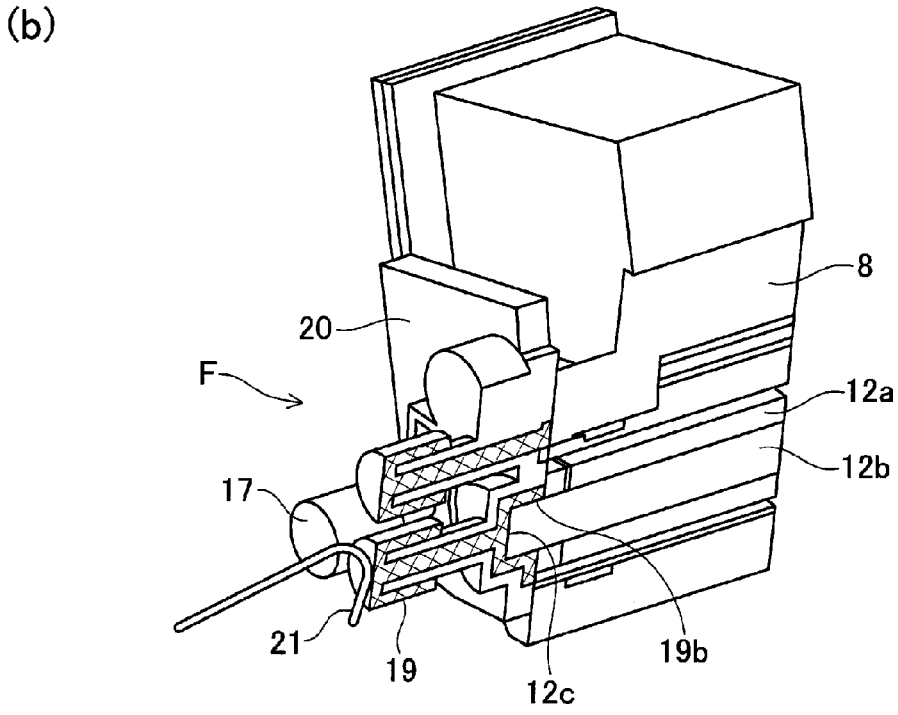

Parts (a) and (b) of FIG. 3 are schematic views for illustrating a developing cartridge in Embodiment 1.

Figure 4:
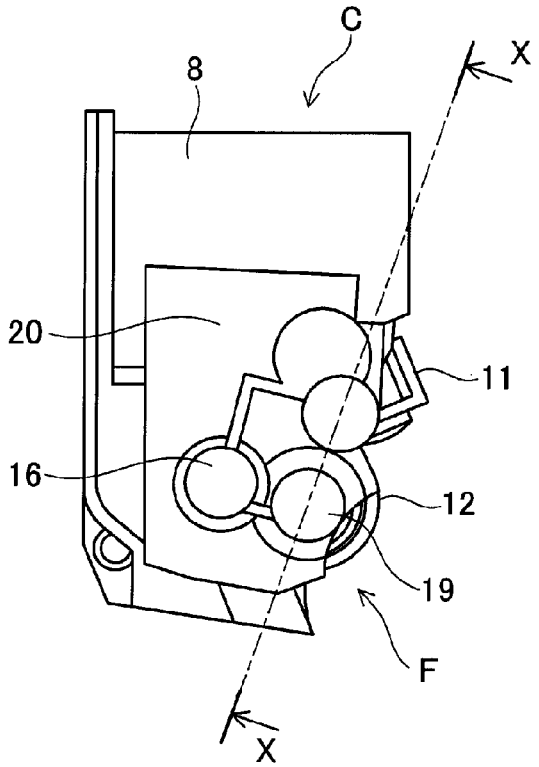
Figure 4:
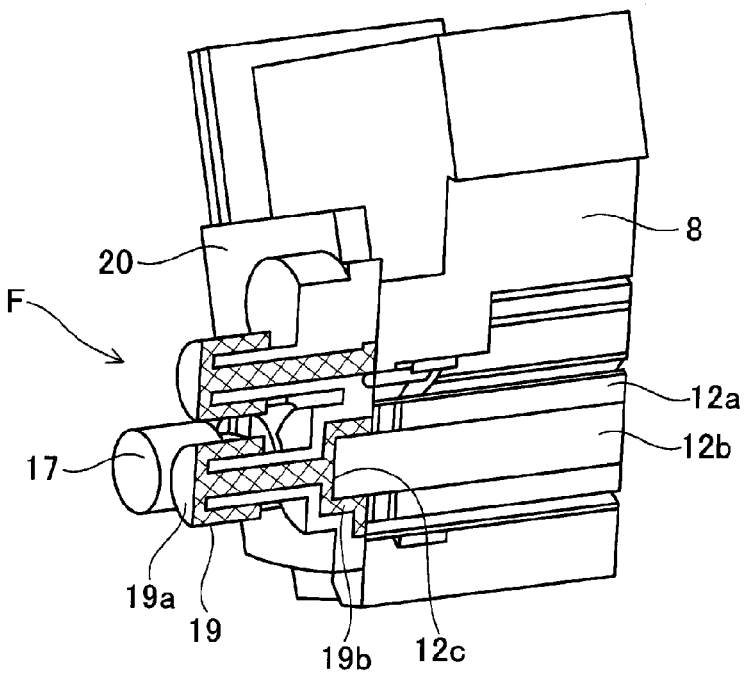

Parts (a) and (b) of FIG. 4 are sectional views showing a bearing member for the developing cartridge and its peripheral members in Embodiment 1.

Figure 5:
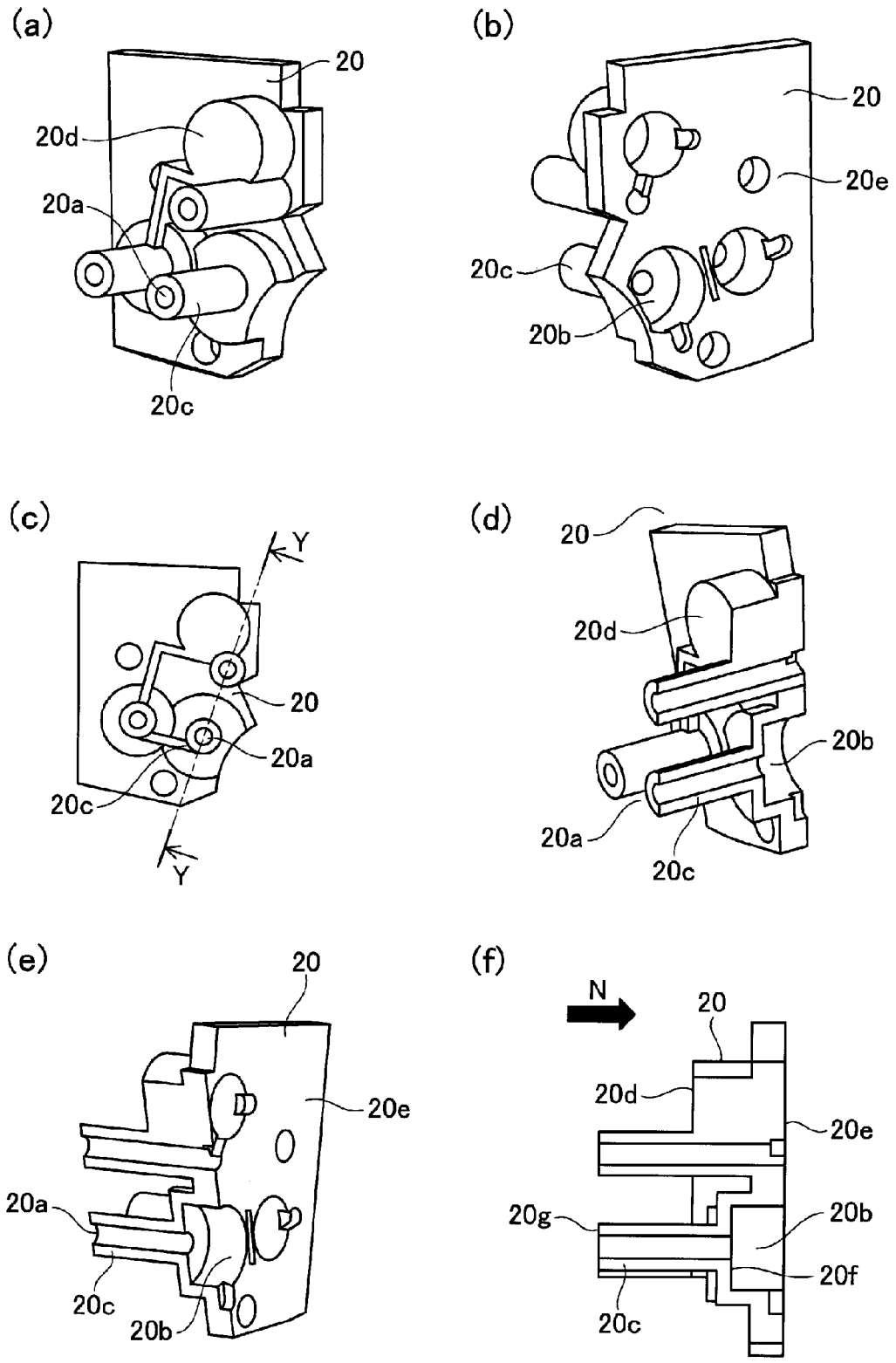

Parts (a) to (f) of FIG. 5 are schematic views for illustrating the bearing member in Embodiment 1.

Figure 6:
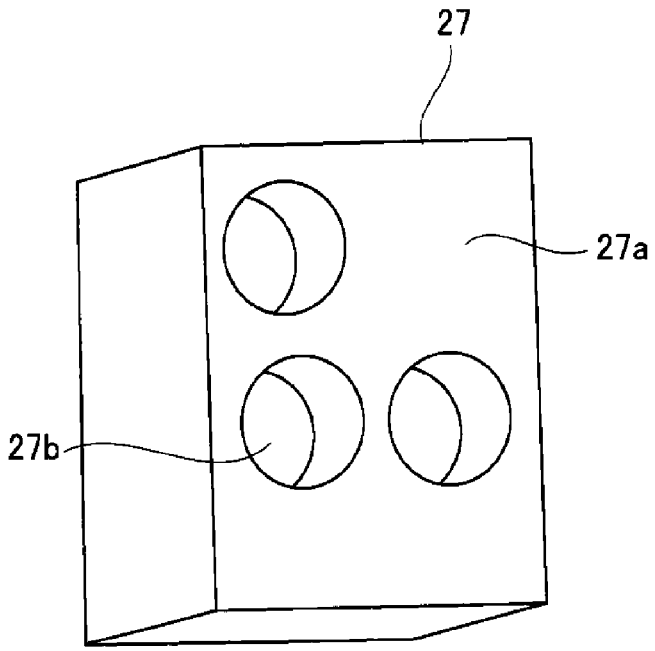

FIG. 6 is a schematic view for illustrating a mold used when a contact surface of the contact portion is formed in Embodiment 1.

Figure 7:
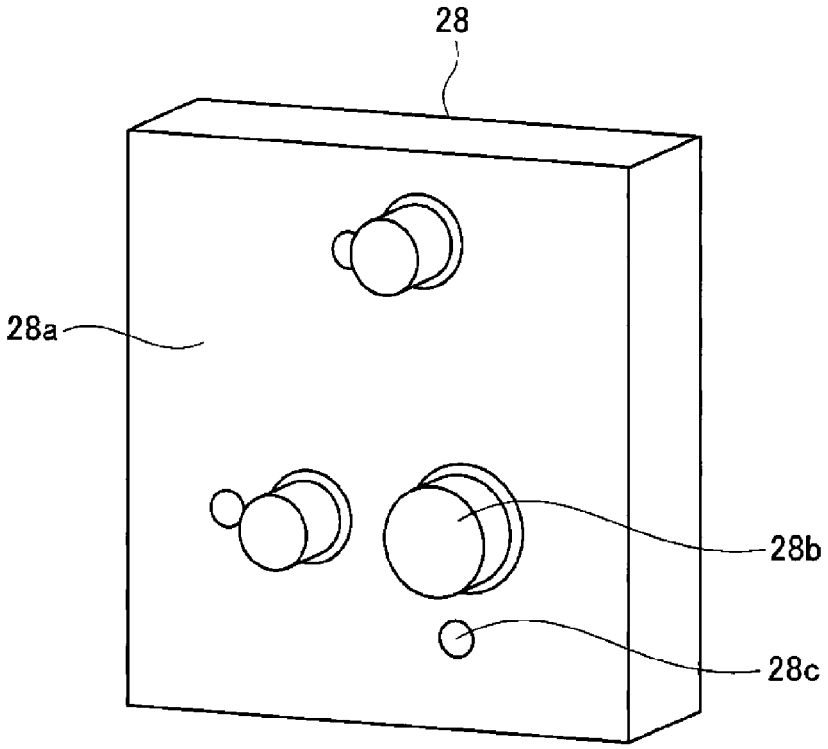

FIG. 7 is a schematic view for illustrating a mold used when a core metal supporting portion of the contact portion is formed in Embodiment 1.

Figure 8:
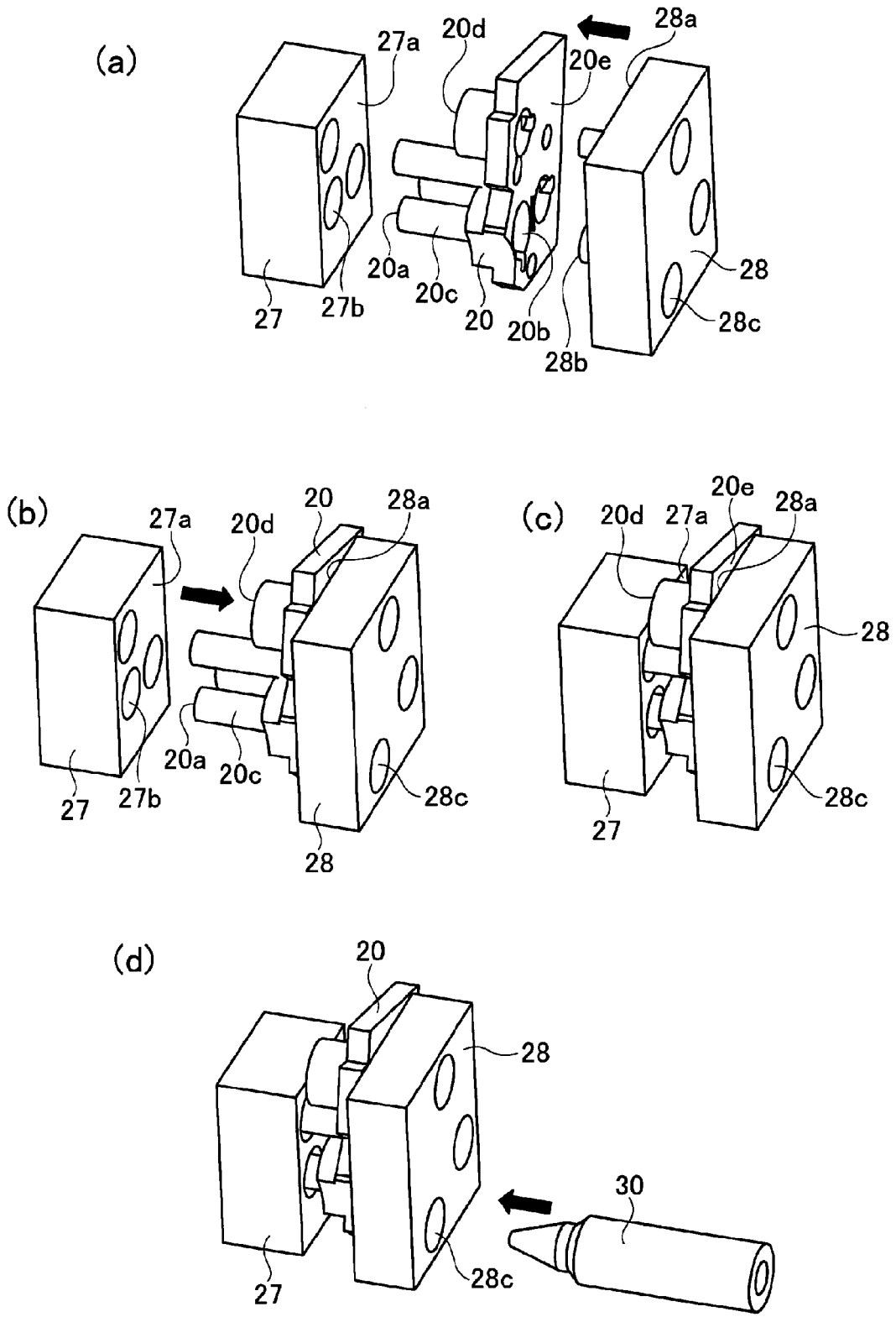

Parts (a) to (d) of FIG. 8 are schematic views for illustrating an operation of the bearing member and the molds until the molds are clamped in Embodiment 1.

Figure 9:
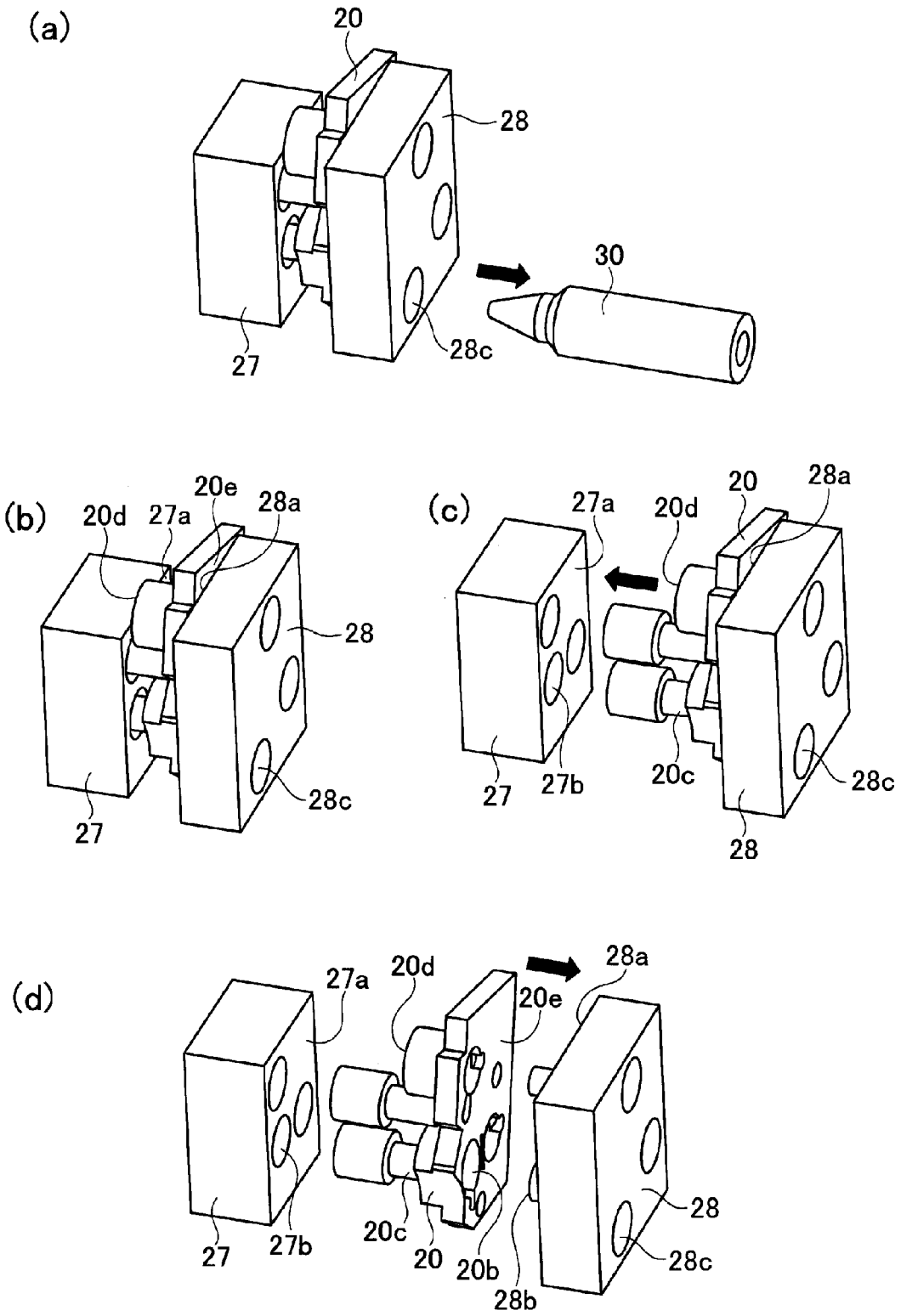

Parts (a) to (d) of FIG. 9 are schematic views for illustrating an operation from after the resin material is injected until the molds are separated from the bearing member in Embodiment 1.

Figure 10:
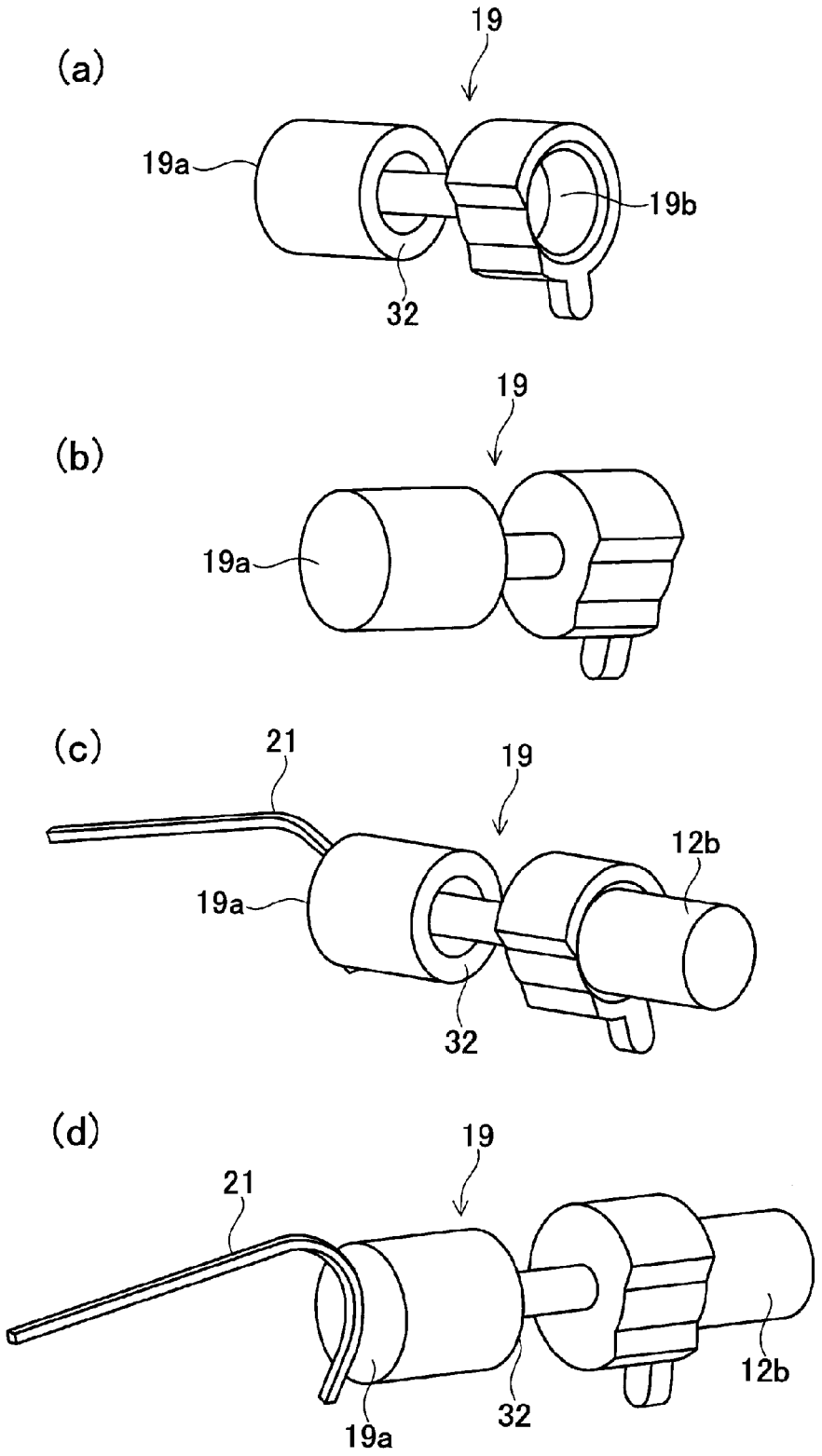

Parts (a) to (d) of FIG. 10 are schematic views for illustrating a function of the molded contact portion in Embodiment 1.

Figure 11:
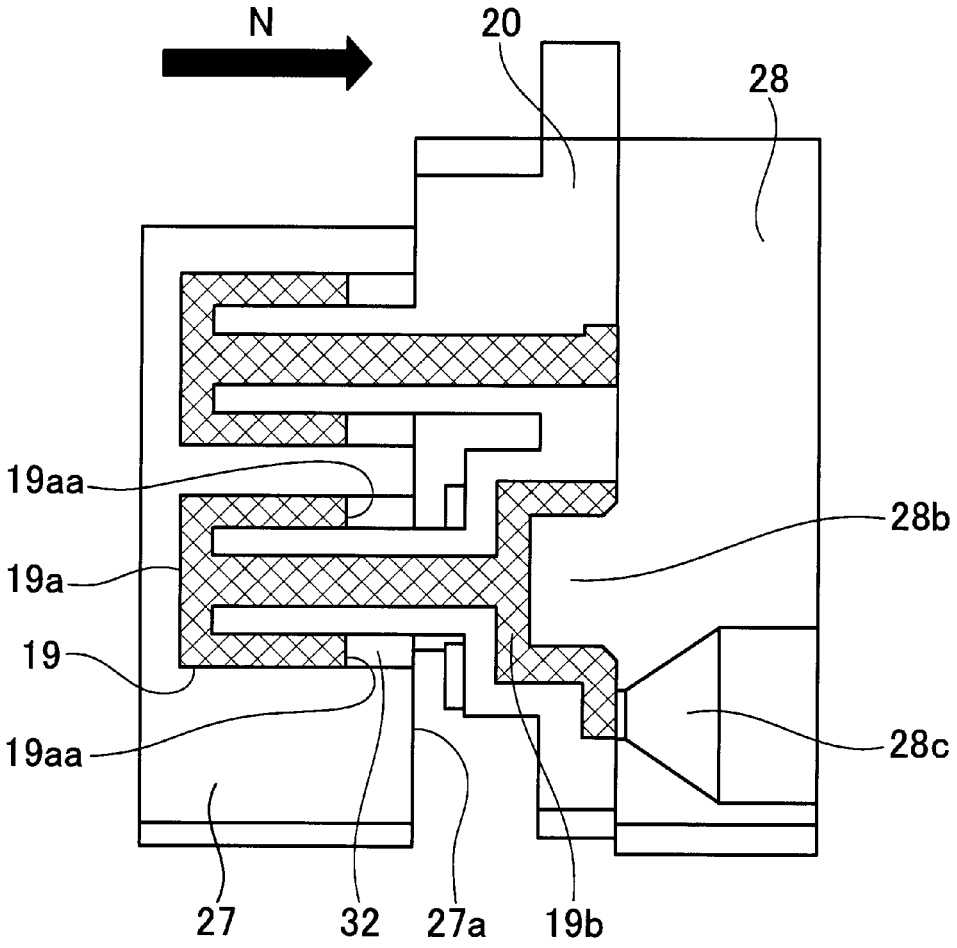

FIG. 11 is a schematic view for illustrating a buffer portion of the contact portion in Embodiment 1.

Figure 12:
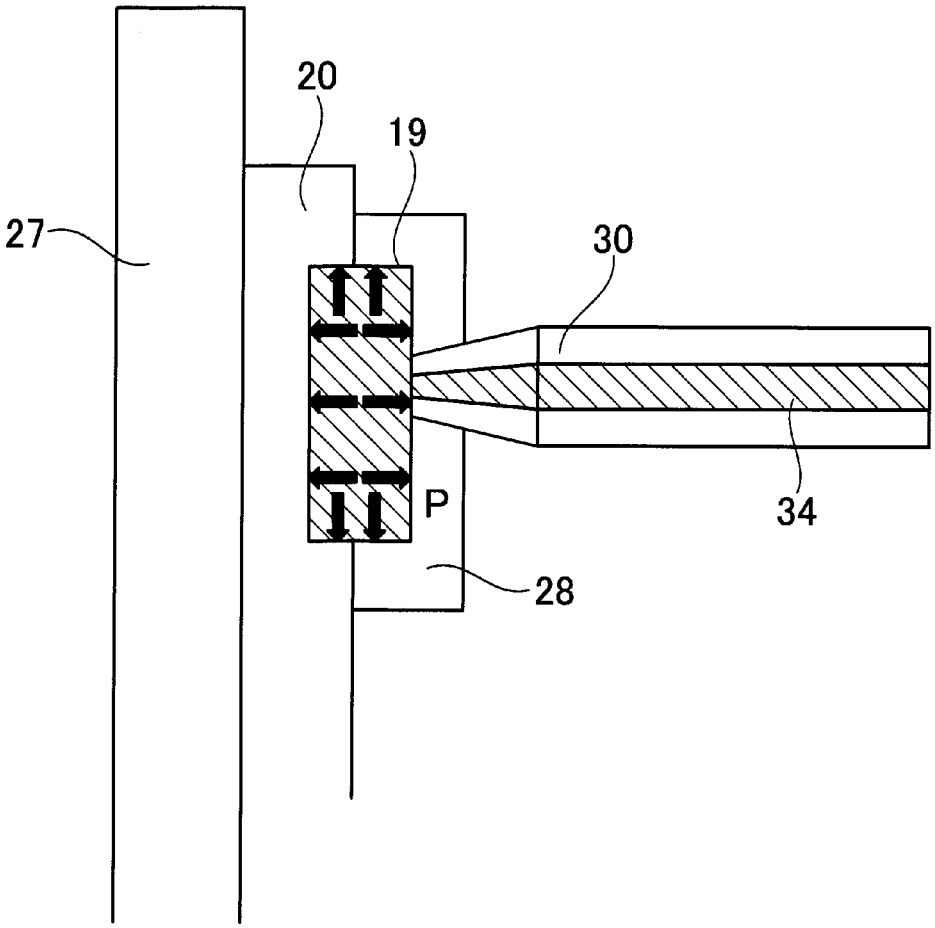

FIG. 12 is a schematic view for illustrating a resin material pressure during resin material injection in Embodiment 1.

Figure 13:
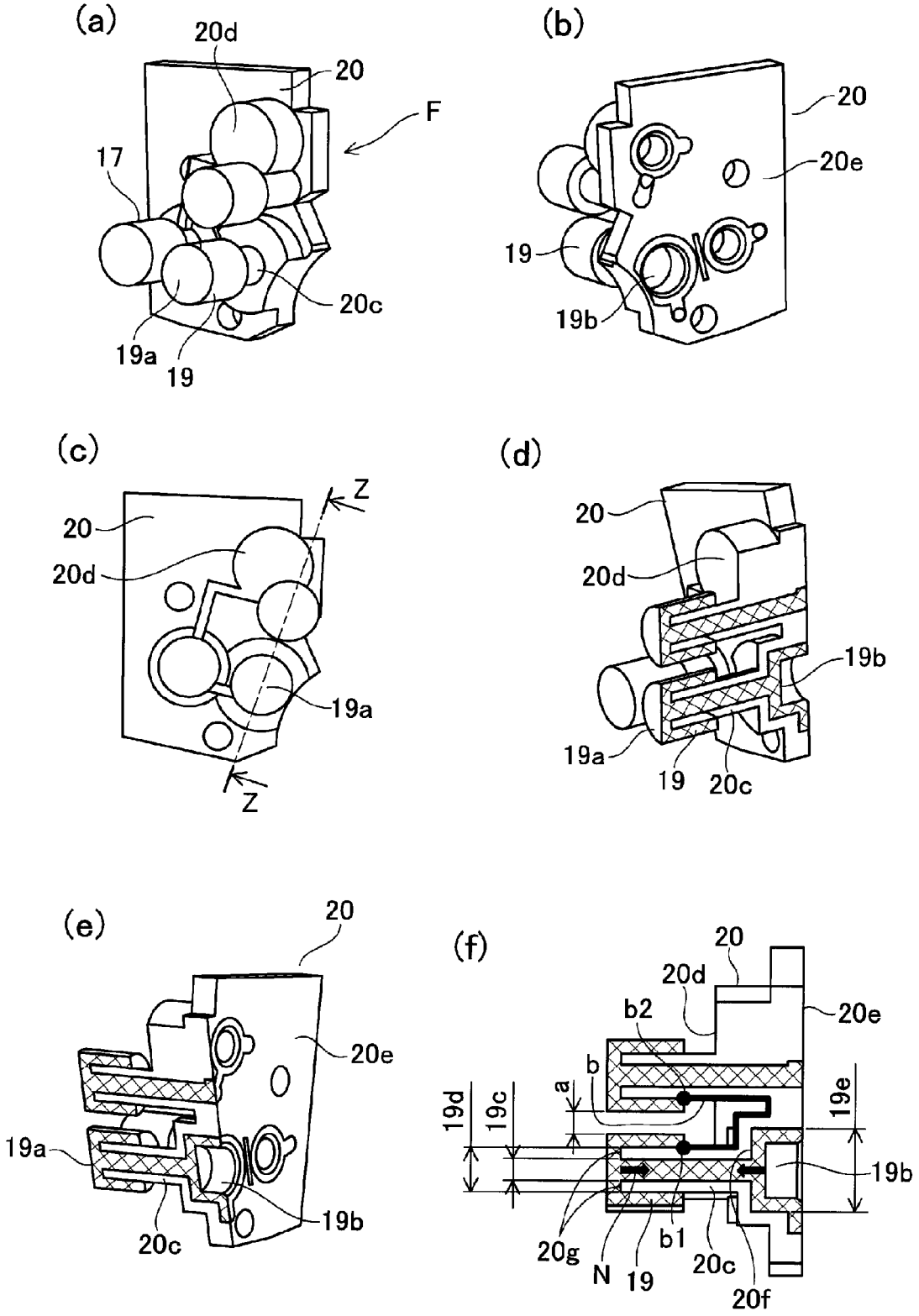

Parts (a) to (f) of FIG. 13 are schematic views for illustrating the bearing member in which the contact portion is molded in Embodiment 1.

Figure 14:
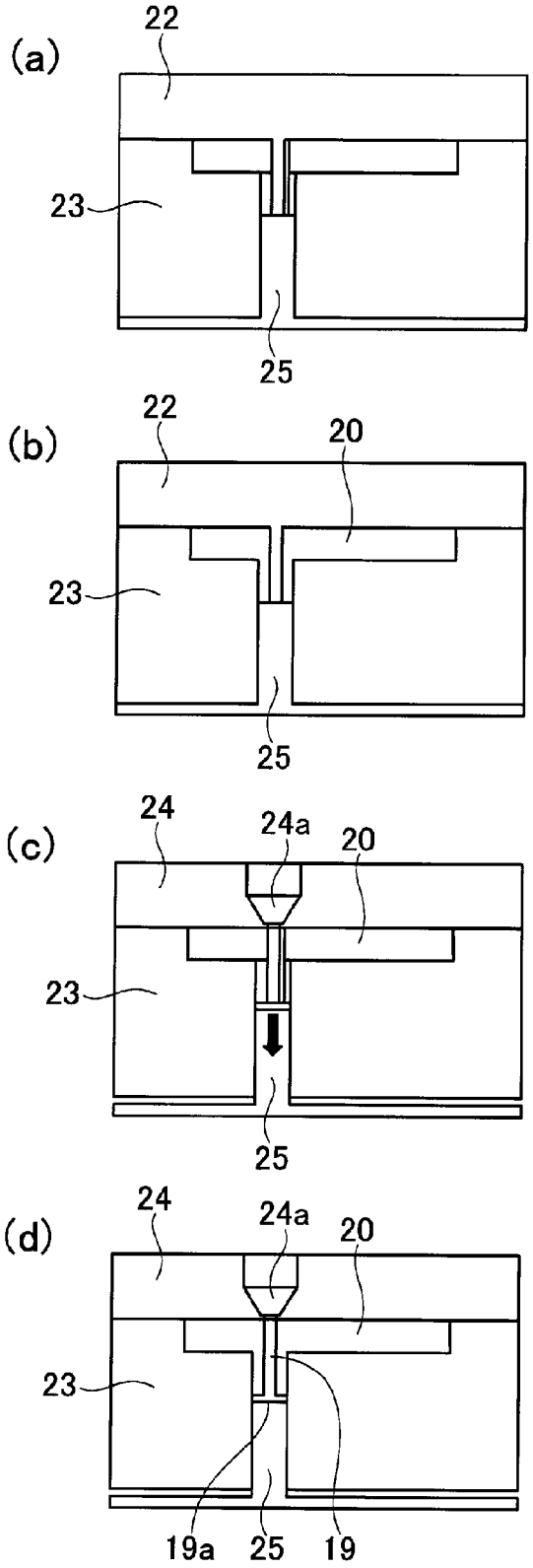

Parts (a) to (d) of FIG. 14 are schematic views for illustrating two-color molding using the bearing member and the electroconductive resin material in Embodiment 1.

Figure 15:
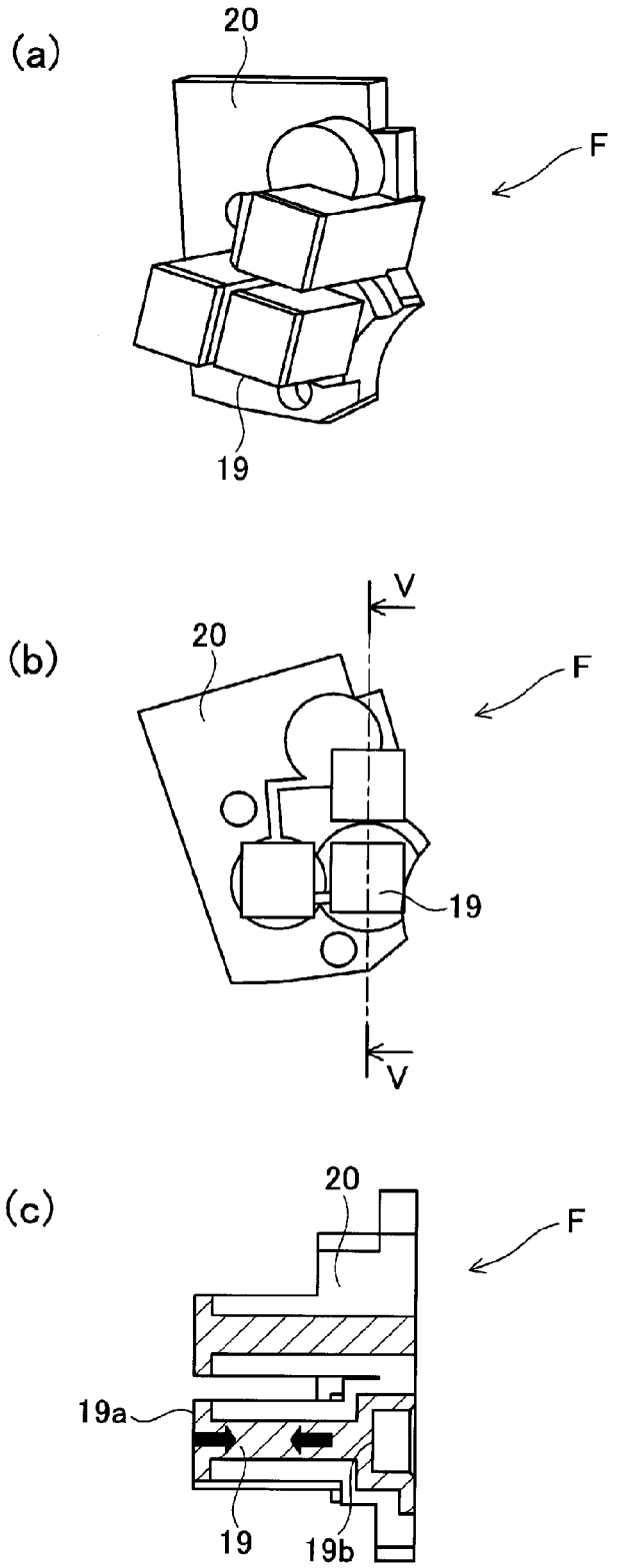

Parts (a), (b) and (c) of FIG. 15 are schematic views for illustrating the bearing member and the contact portion which are molded by the two-color molding in Embodiment 1.

Figure 16:
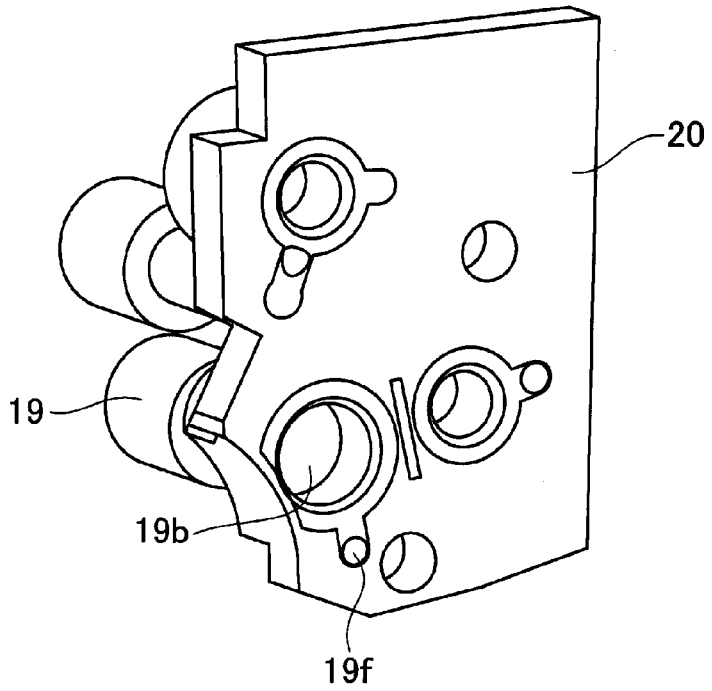
Figure 16:
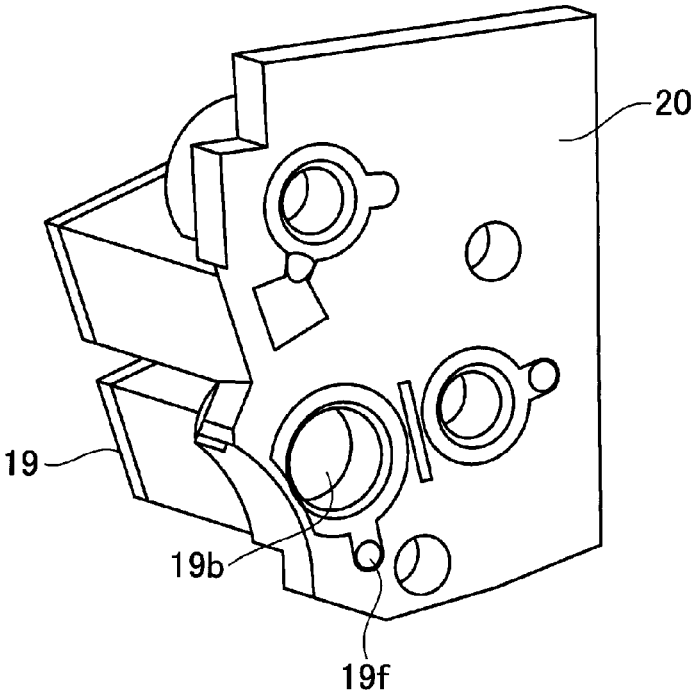

Parts (a) and (b) of FIG. 16 are schematic views for illustrating a gate position in Embodiment 1.

Figure 17:
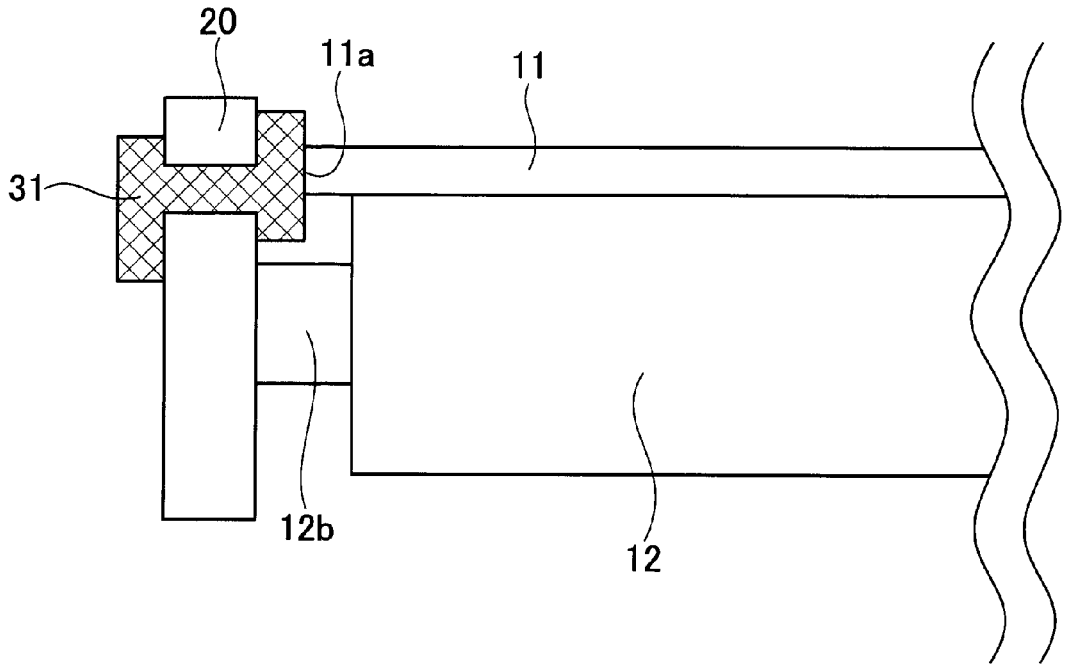

FIG. 17 is a schematic view for illustrating a constitution for applying a voltage to a process means other than a rotatable member.

Figure 18:
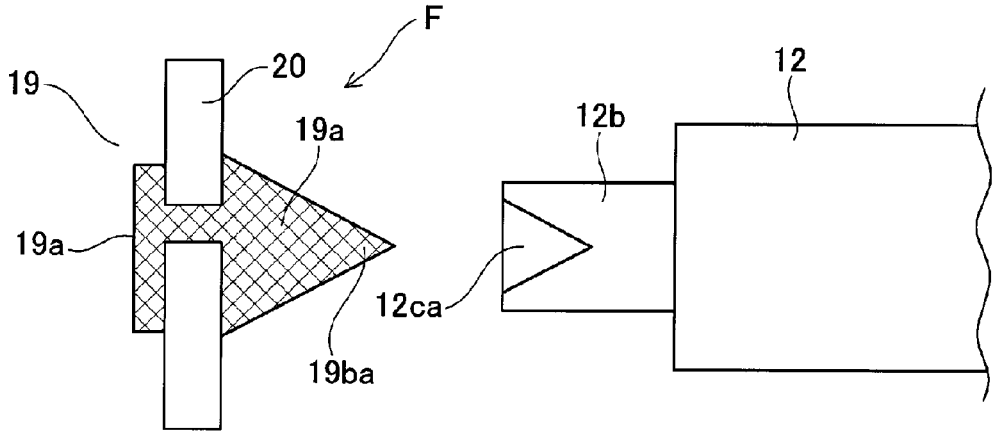
Figure 18:
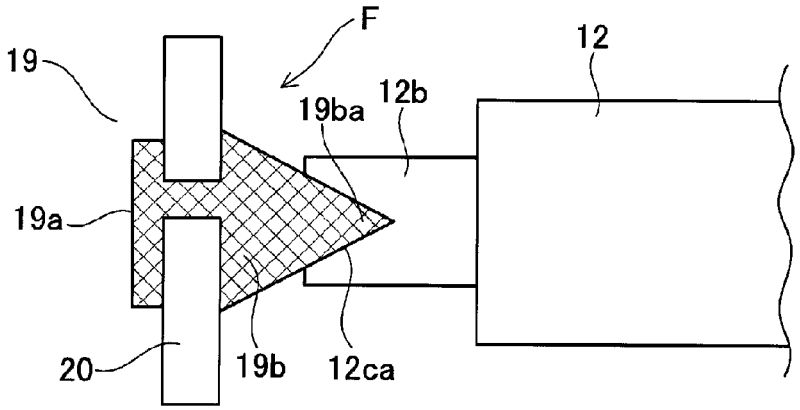

Parts (a) and (b) of FIG. 18 are schematic views for illustrating another constitution for supporting the core metal.

Figure 19:
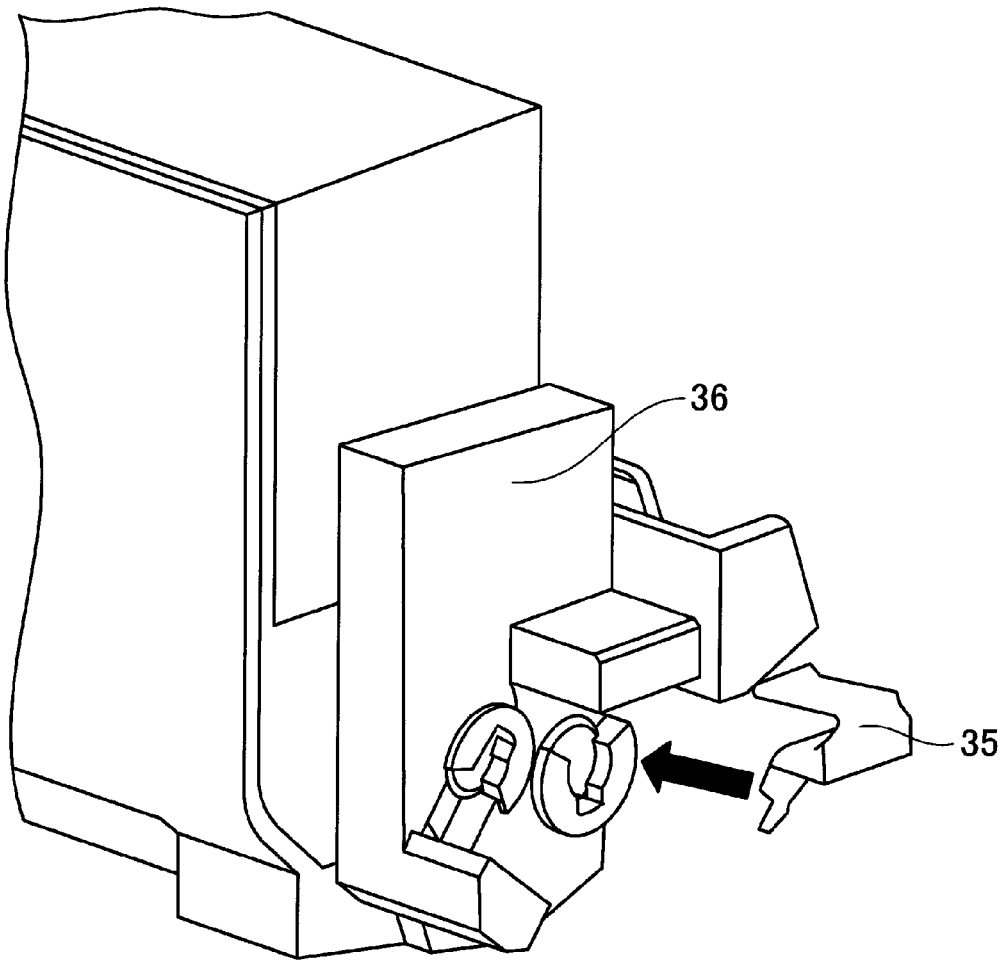

FIG. 19 is a schematic view for illustrating a conventional constitution using a metal plate as a contact portion.

Figure 20:
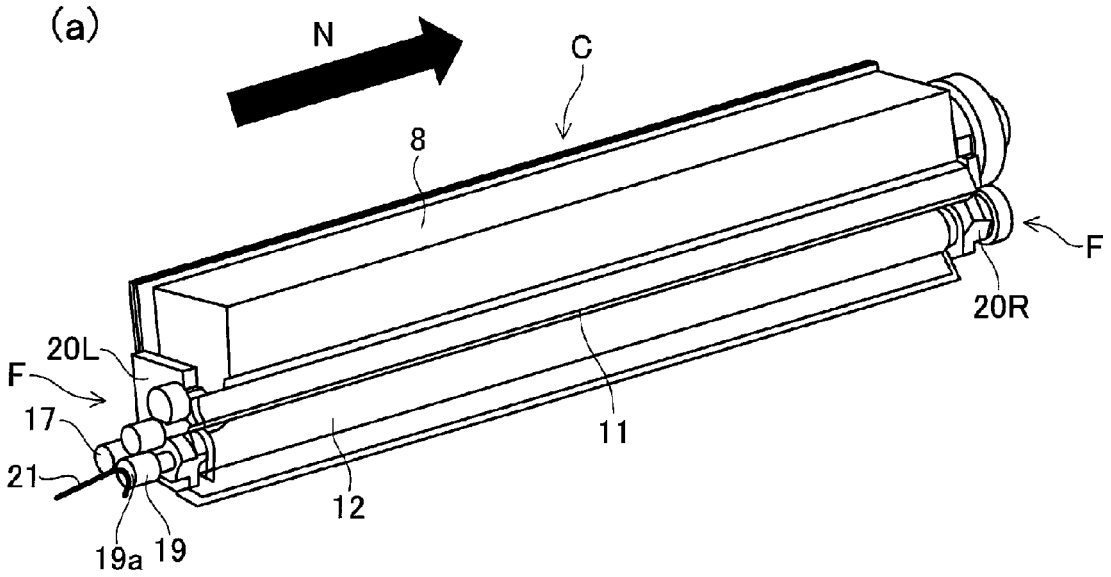
Figure 20:
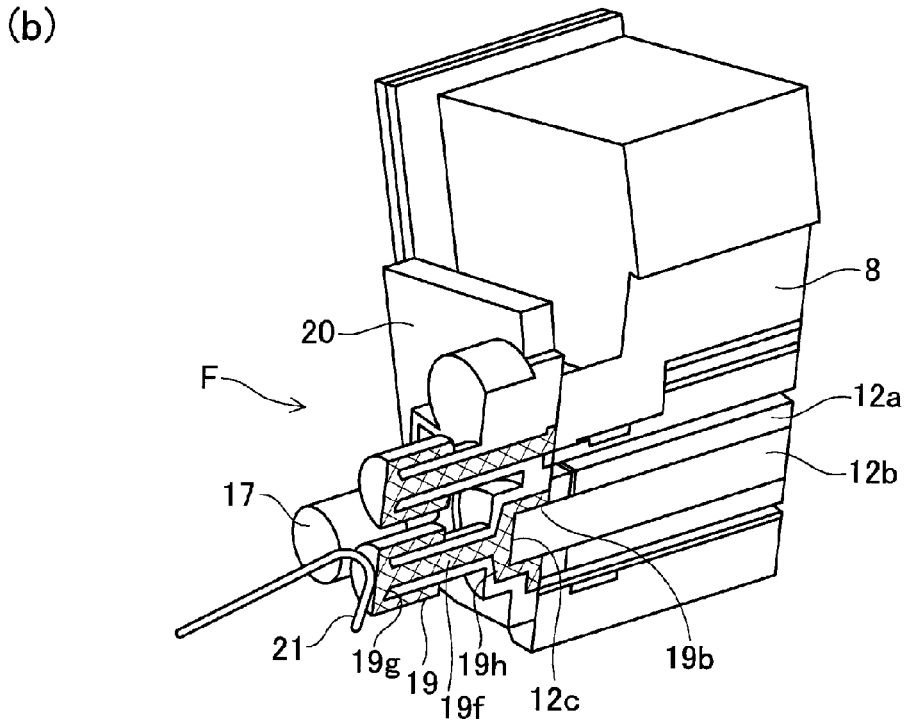

Parts (a) and (b) of FIG. 20 are schematic views for illustrating a developing cartridge in Embodiment 2.

Figure 21:
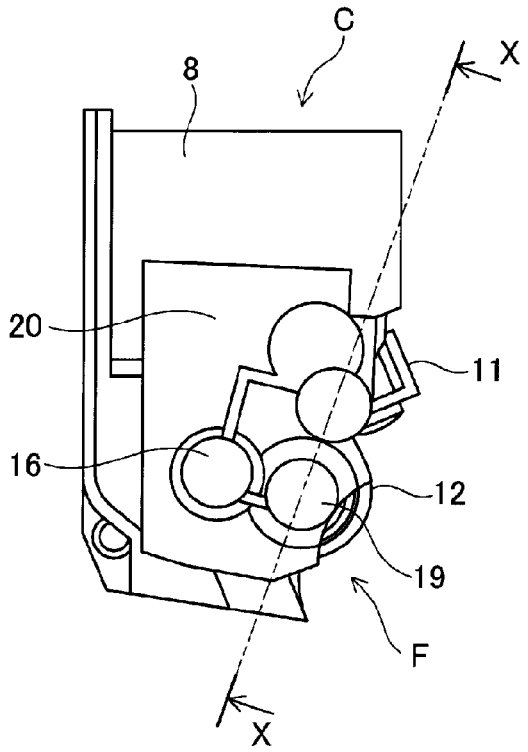
Figure 21:
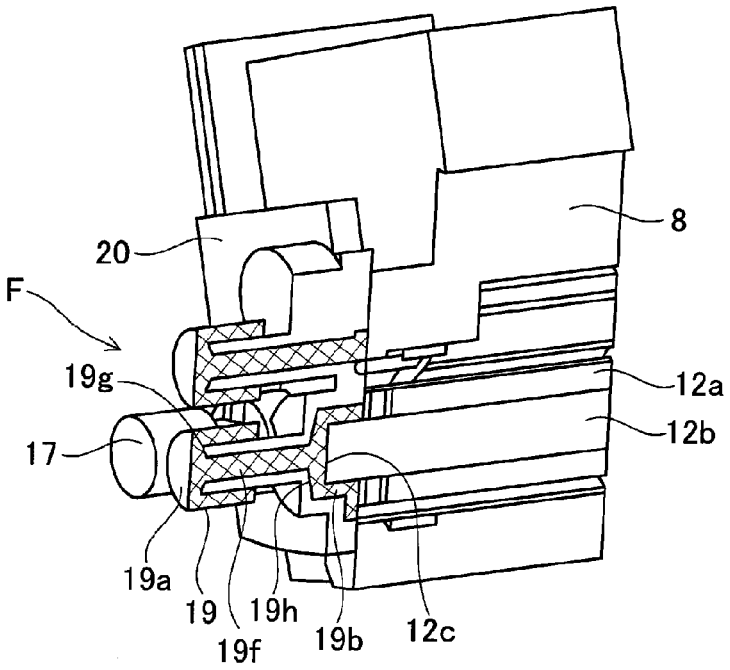

Parts (a) and (b) of FIG. 21 are schematic views for illustrating a bearing member of the developing cartridge and its peripheral members in Embodiment 2.

Figure 22:
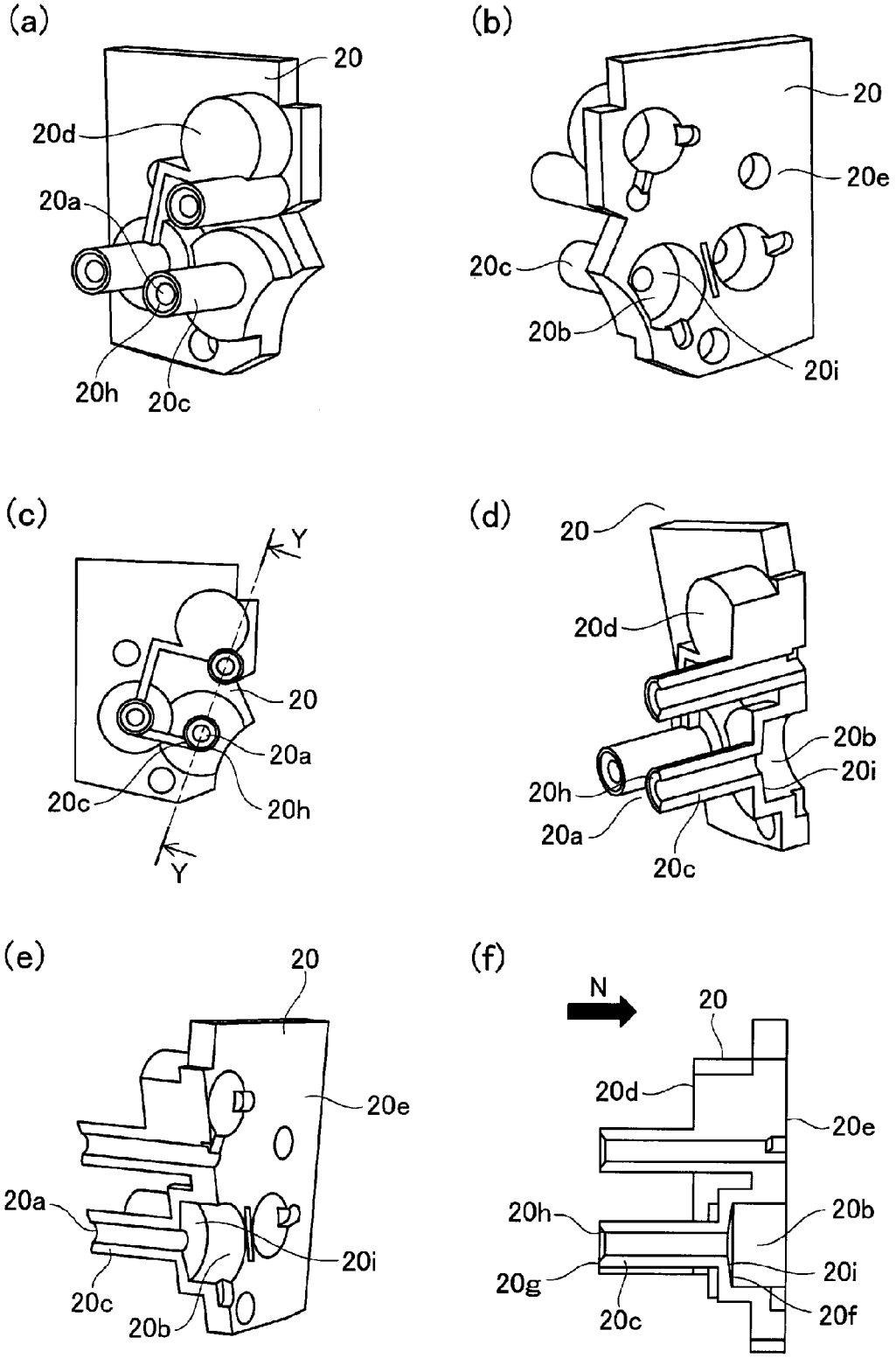

Parts (a) to (f) of FIG. 22 are schematic views for illustrating the bearing member in Embodiment 2.

Figure 23:
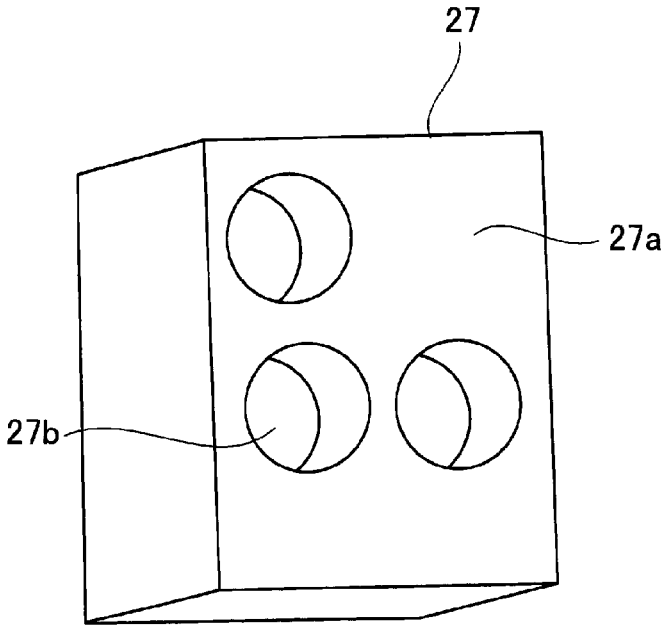

FIG. 23 is a schematic view for illustrating a mold used when a contact surface of the contact portion is formed in Embodiment 2.

Figure 24:
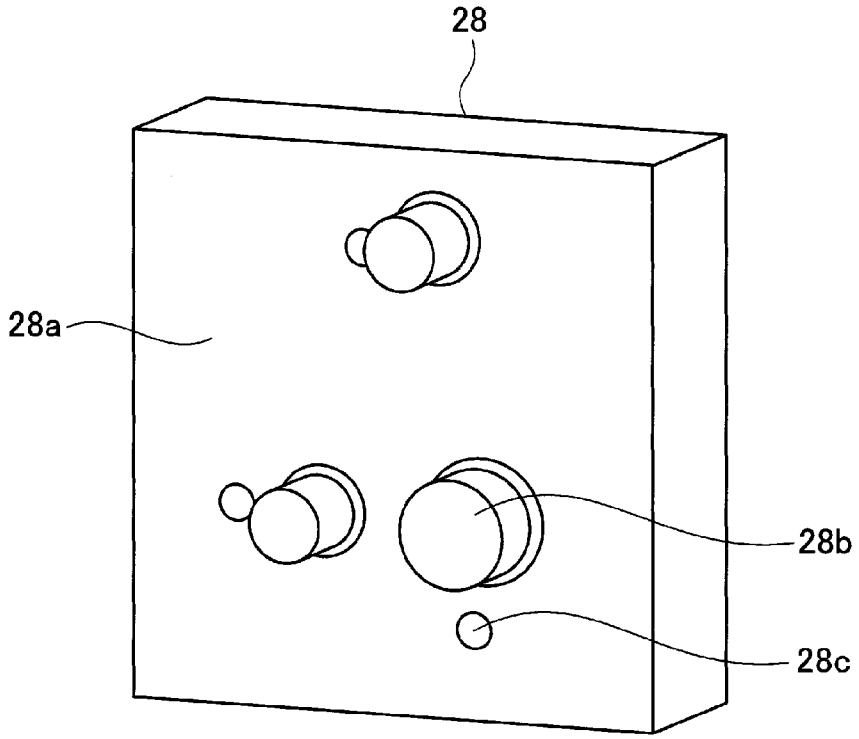

FIG. 24 is a schematic view for illustrating a mold used when a core metal supporting portion of the contact portion is formed in Embodiment 2.

Figure 25:
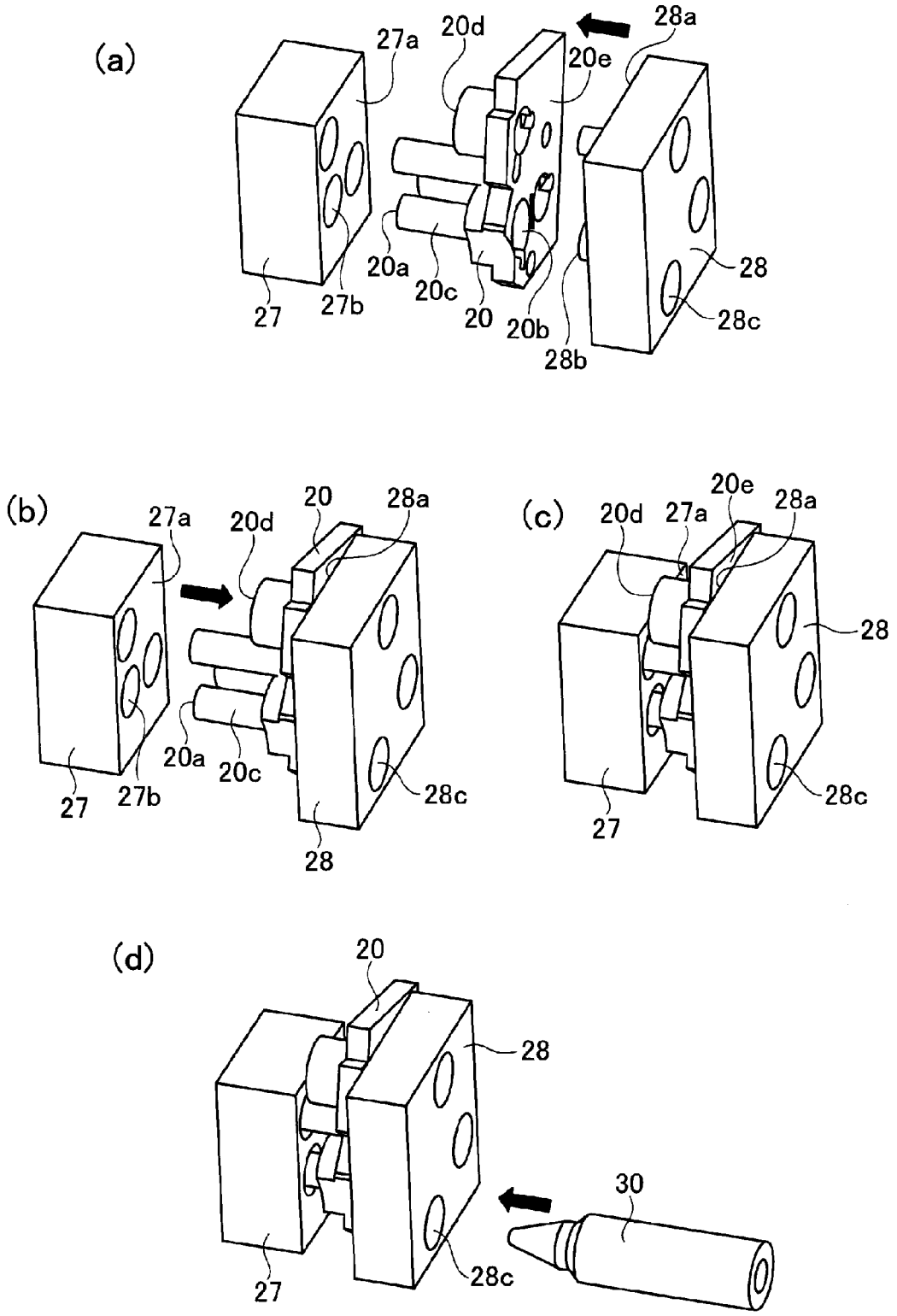

Parts (a) to (d) of FIG. 25 are schematic views for illustrating an operation of the bearing member and the molds until the molds are clamped in Embodiment 2.

Figure 26:
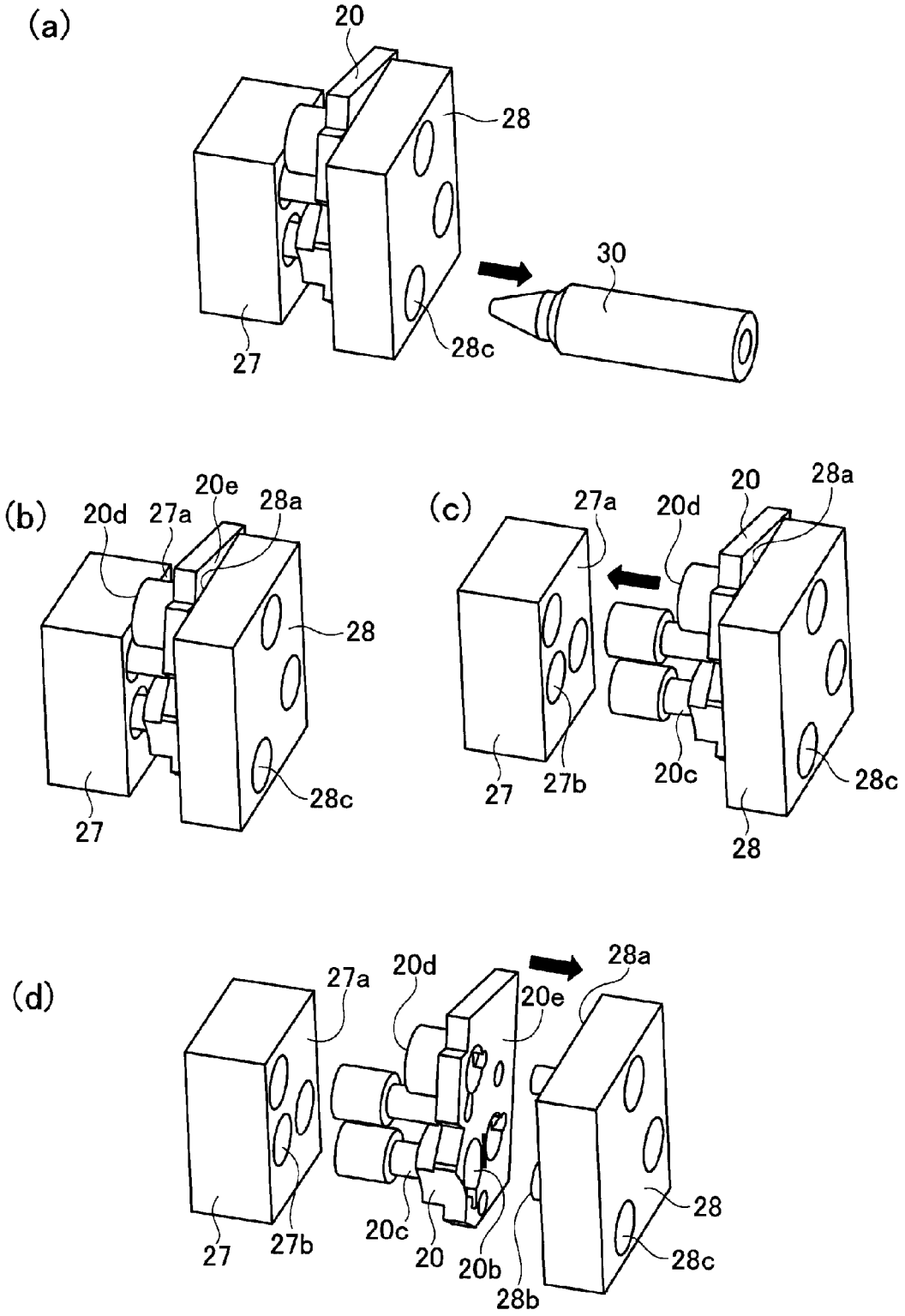

Parts (a) to (d) of FIG. 26 are schematic views for illustrating an operation from after the resin material is injected until the molds are separated from the bearing member in Embodiment 2.

Figure 27:
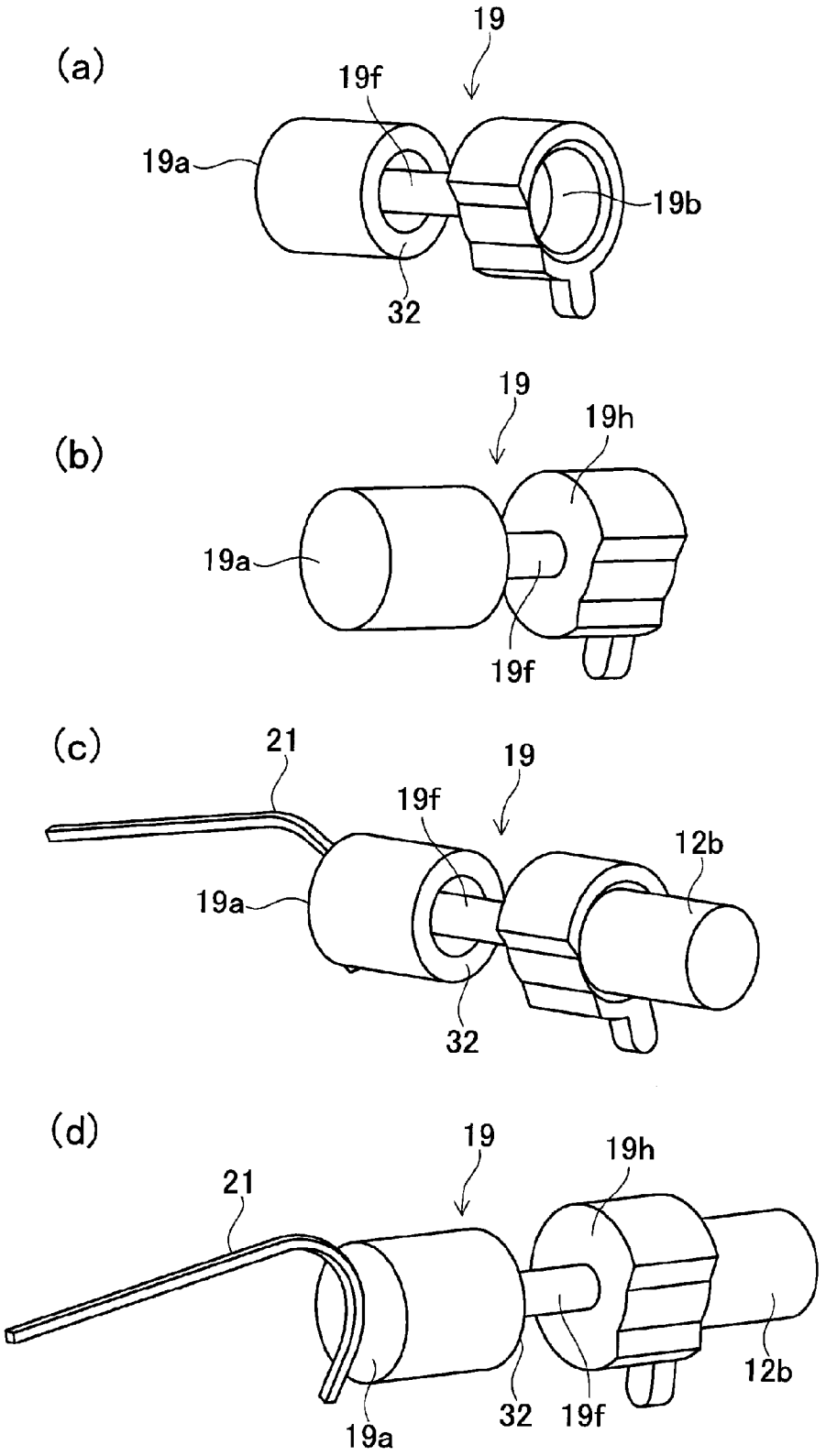

Parts (a) to (d) of FIG. 27 are schematic views for illustrating a function of the molded contact portion in Embodiment 2.

Figure 28:
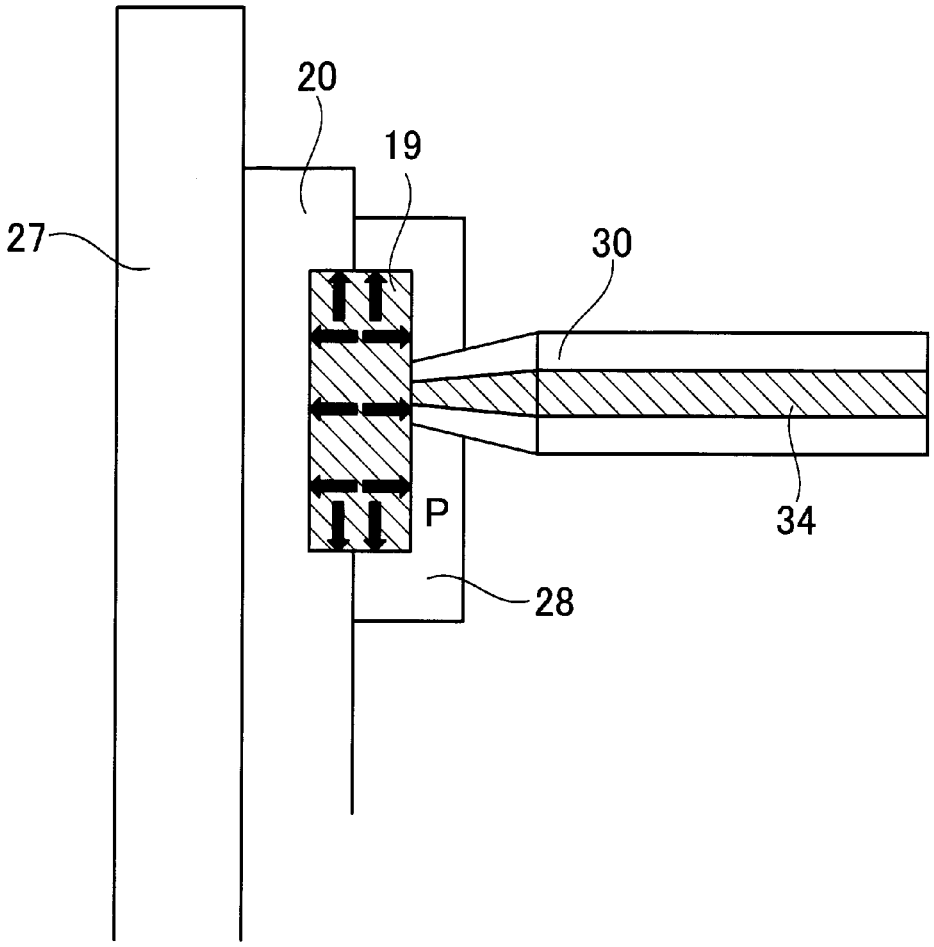

FIG. 28 is a schematic view for illustrating a resin material pressure during resin material injection in Embodiment 2.

Figure 29:
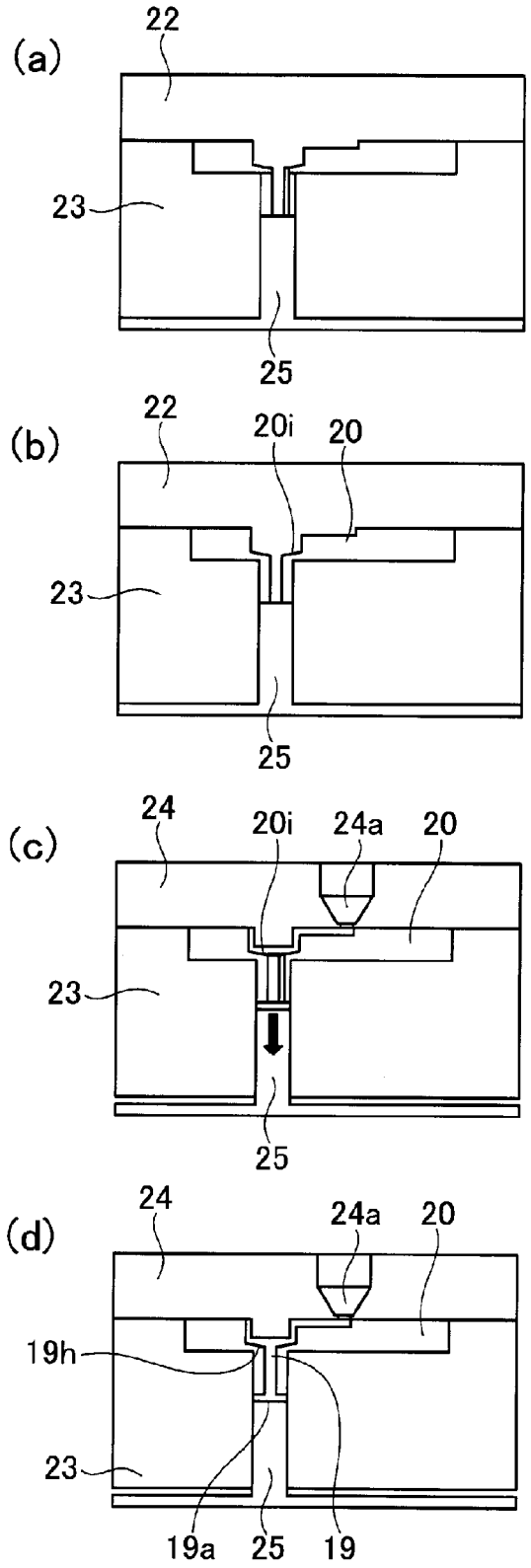

Parts (a) to (d) of FIG. 29 are schematic views for illustrating two-color molding using the bearing member and the electroconductive resin material in Embodiment 2.

Figure 30:
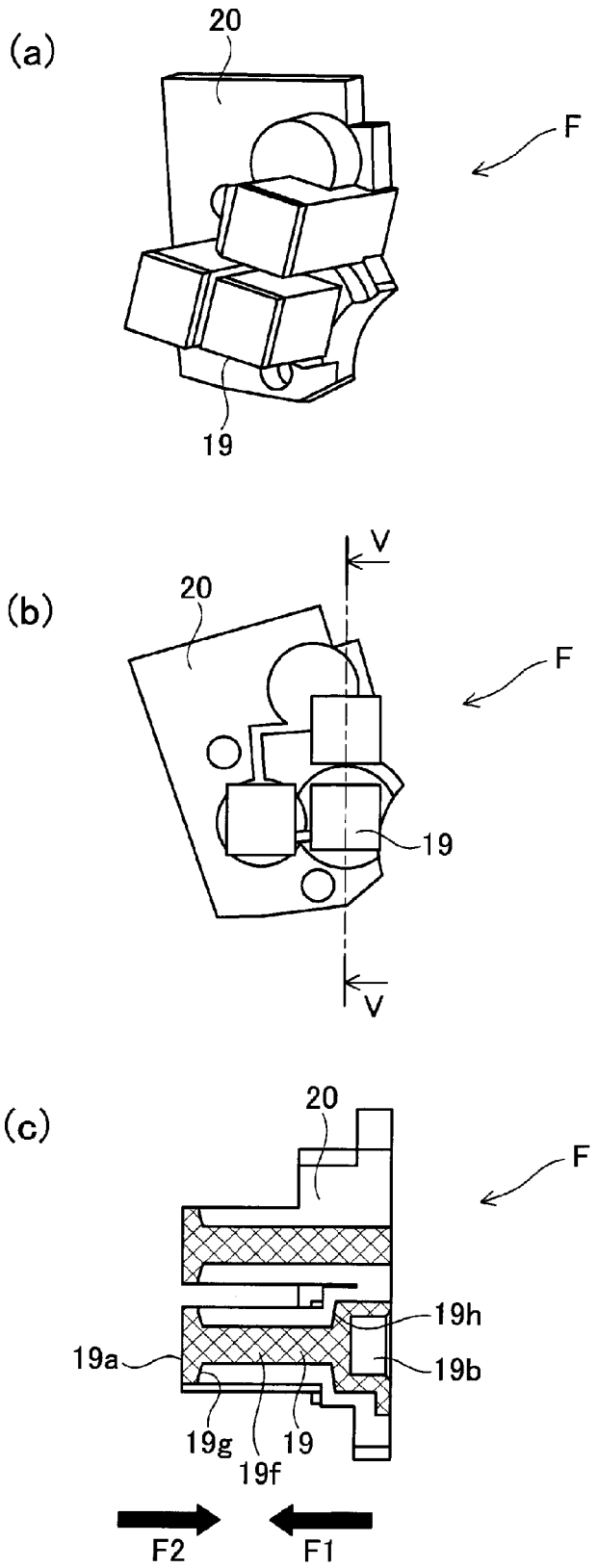

Parts (a), (b) and (c) of FIG. 30 are schematic views for illustrating the bearing member and the contact portion which are molded by the two-color molding in Embodiment 2.

Figure 31:
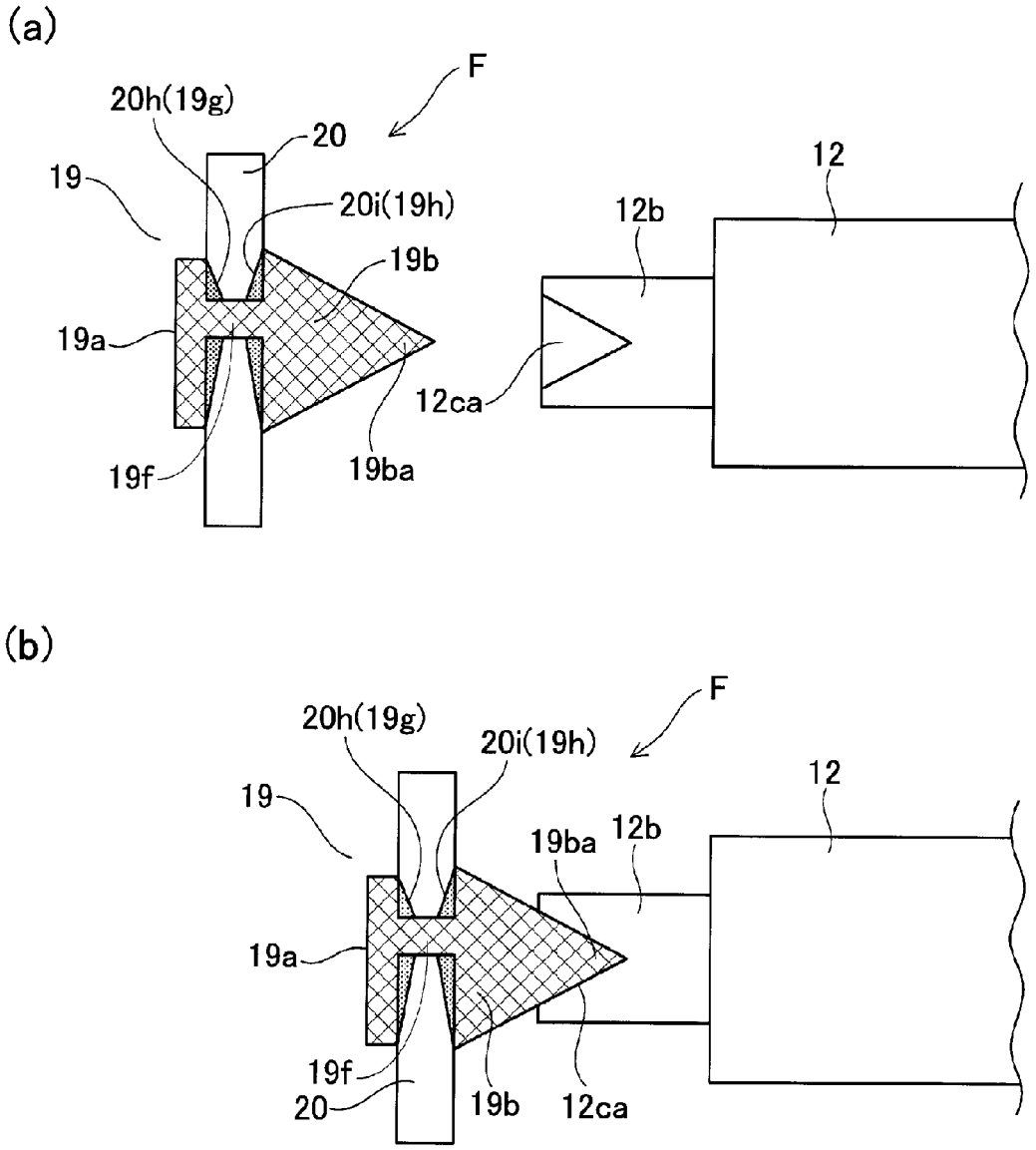

Parts (a) and (b) of FIG. 31 are schematic views for illustrating another constitution for supporting the core metal.

Figure 32:
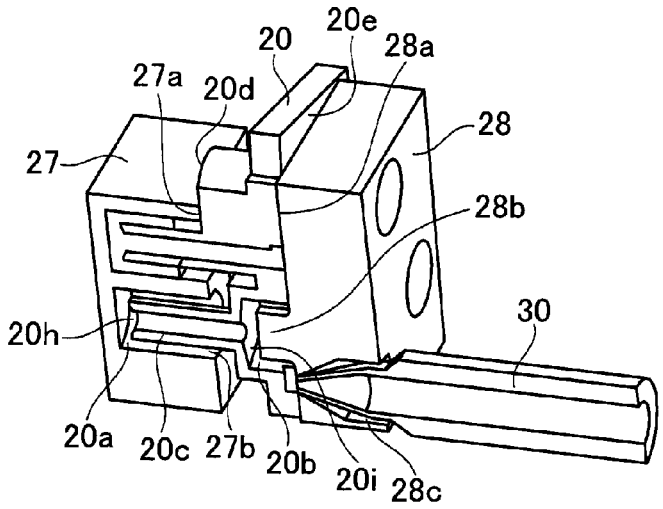
Figure 32:
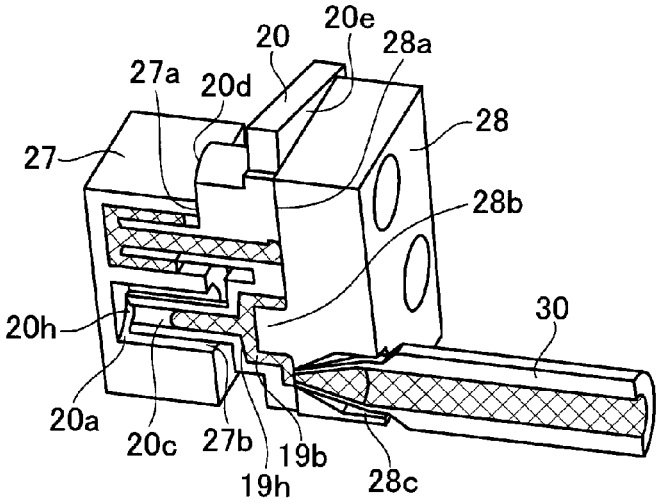
Figure 32:
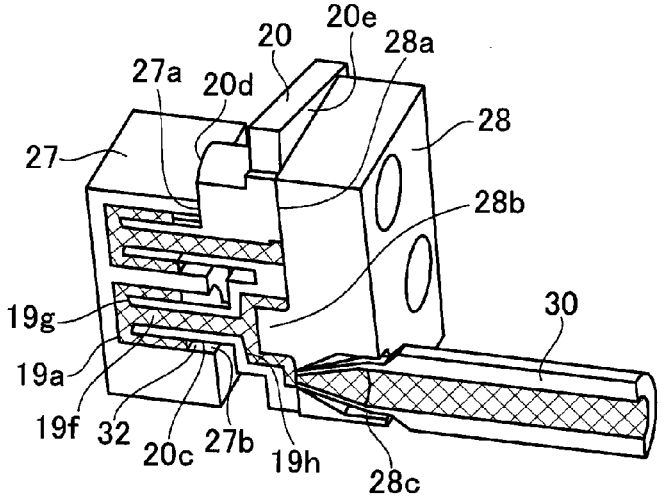

Parts (a), (b) and (c) of FIG. 32 are schematic views showing progression after the electroconductive resin material is injected for forming the contact portion in Embodiment 2.

Figure 33:
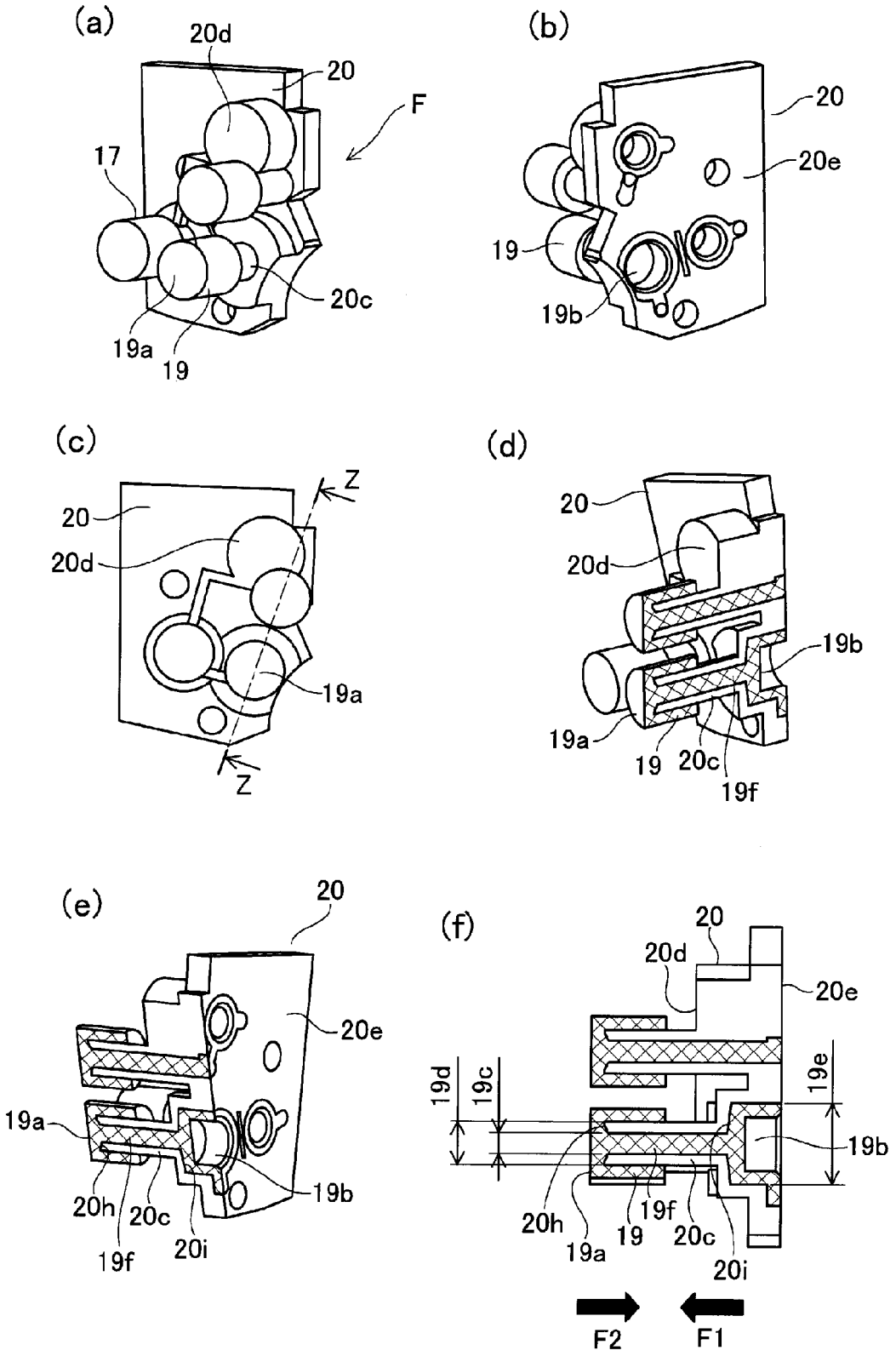

Parts (a) to (f) of FIG. 33 are schematic views for illustrating the bearing member for which the contact portion is molded in Embodiment 2.

Figure 34:
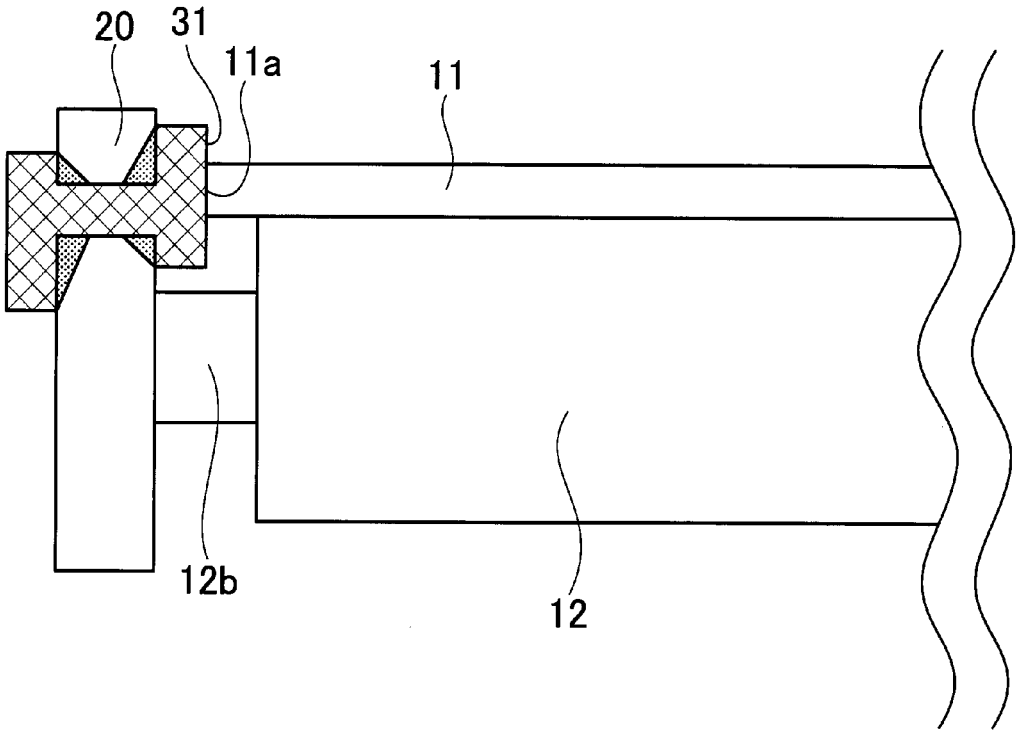

FIG. 34 is a schematic view for illustrating a constitution for applying a voltage to a process means other than a rotatable member.

Figure 35:
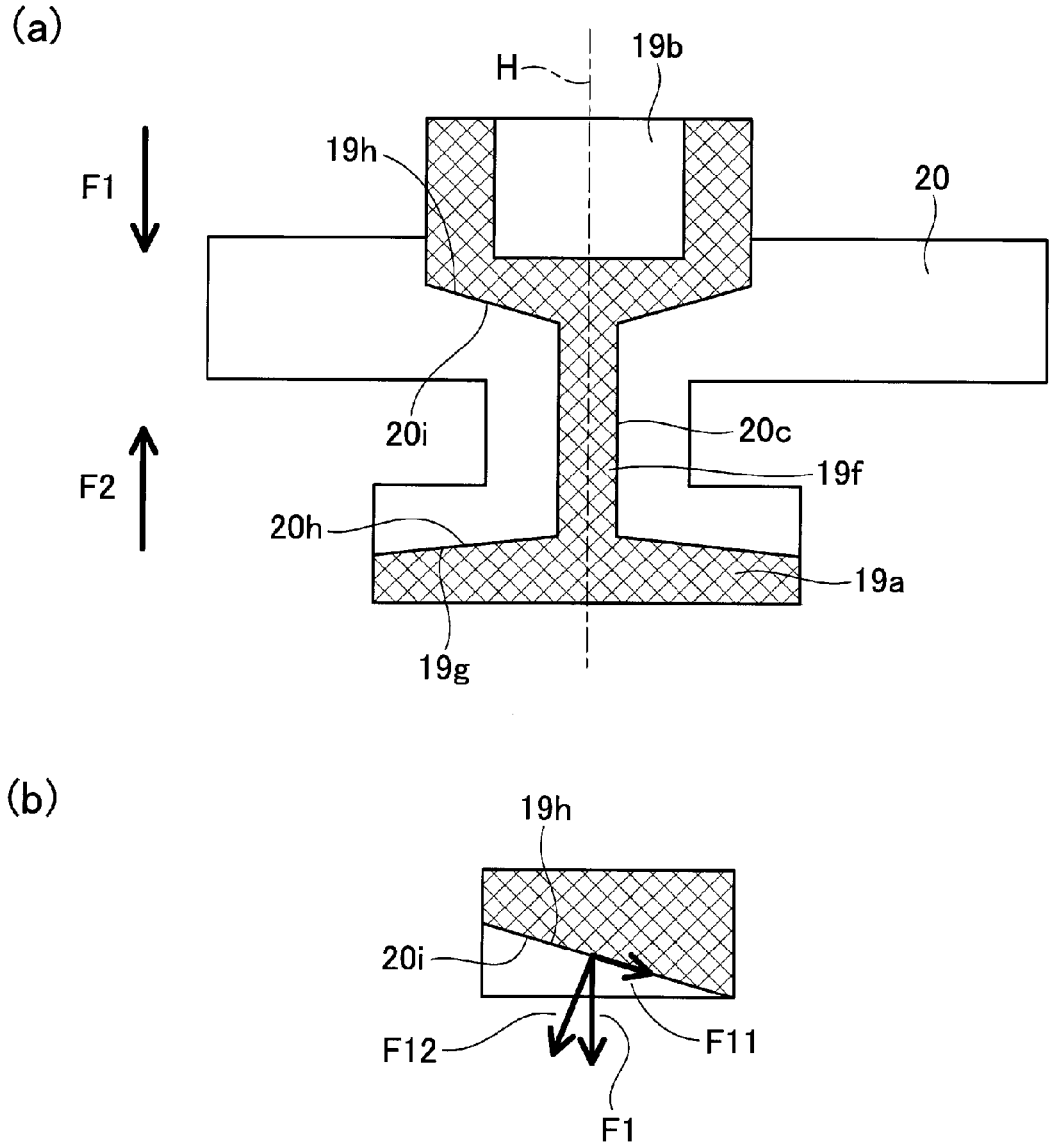

Parts (a) and (b) of FIG. 35 are schematic sectional views showing structures of the bearing member and the contact portion in Embodiment 2.

DESCRIPTION OF THE PREFERRED EMBODIMENTS

Hereinbelow, embodiments for carrying out the present invention will be exemplarily and specifically described with reference to the drawings. However, dimensions, materials, shapes, relative arrangements and the like of constituent elements described in the following embodiments are appropriately changed depending on constitutions or various conditions of devices (apparatuses) to which the present invention is applied and thus the scope of the present invention is not limited thereto.

The present invention relates to a cartridge detachably mountable to a main assembly of an electrophotographic image forming apparatus. Here, the electrophotographic image forming apparatus forms an image on a recording material by using an image forming process of an electrophotographic type. Examples of the electrophotographic image forming apparatus may include an electrophotographic copying machine, an electrophotographic printer (such as a laser beam printer or an LED printer), a facsimile machine and a word processor.

Further, the cartridge is a generic name for a drum cartridge for supporting an electrophotographic photosensitive drum (electrophotographic photosensitive member), a developing cartridge for supporting a developing means, a process cartridge prepared by assembling the electrophotographic photosensitive drum and a process means into a cartridge (unit), and the like cartridge. The process means acts on the electrophotographic photosensitive drum. Examples thereof may include a charging means, the developing means, a cleaning means and the like, which act on the electrophotographic photosensitive drum, and in addition, may include a toner supplying roller for applying a toner onto a developer carrying member (developing roller), a remaining toner amount detecting means, and the like.

Embodiment 1

An electrophotographic image forming apparatus in this embodiment will be described. In the following description, of constituent members of the image forming apparatus, particularly, constitutions of the process cartridge, the developing cartridge and an electric contact portion (contact portion) and a molding method will be specifically described.

(Image Forming Apparatus)

Figure 2:
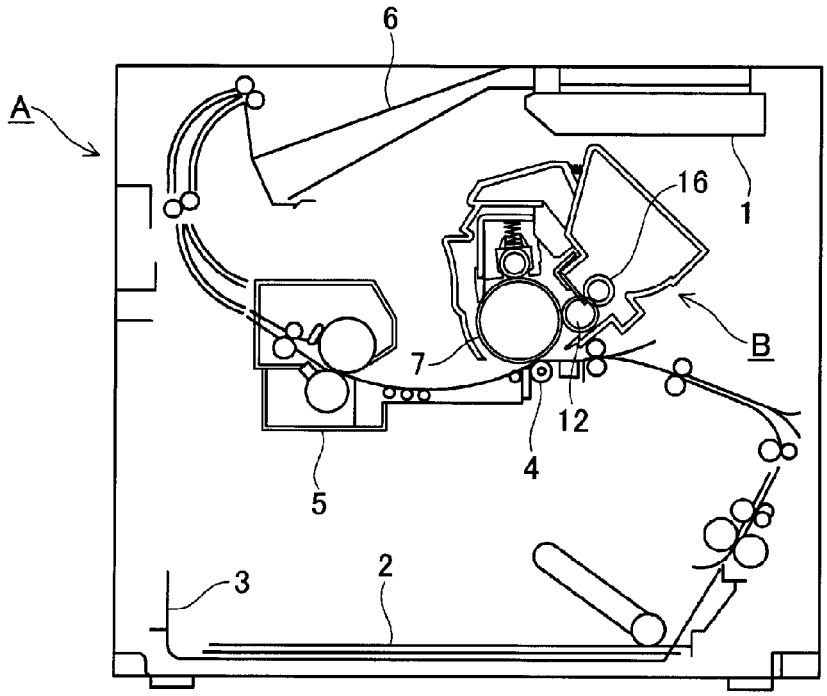
Figure 2:
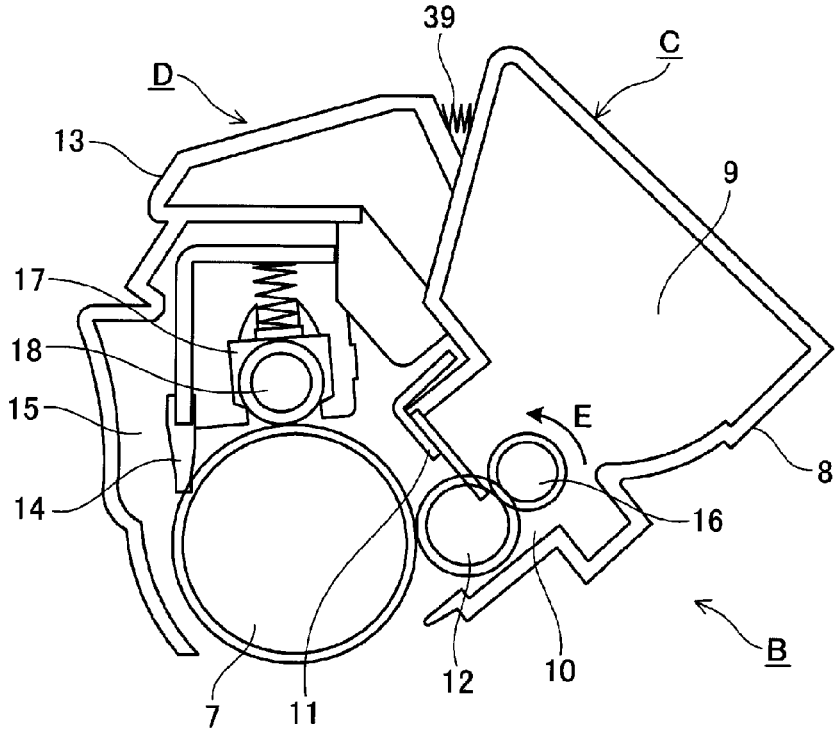

With reference to FIG. 2, an image forming apparatus A in this embodiment will be described.

Part (a) of FIG. 2 a schematic sectional view showing a structure of the image forming apparatus A (laser beam printer) in which a process cartridge B is mounted.

In the image forming apparatus A shown in (a) of FIG. 2, an image is formed on a recording material 2 in the following manner. First, an electrophotographic photosensitive drum 7 is irradiated with information light (laser light), on the basis of image information, emitted from an optical system 1, so that an electrostatic latent image is formed on the photosensitive drum 7 and then is developed with a developer (toner) into a toner image. In synchronism with formation of the toner image, a recording material 2 is conveyed from a feeding cassette 3 and the toner image formed on the photosensitive drum 7 is transferred onto the recording material 2 by a transfer roller 4. Then, the toner image transferred on the recording material 2 is fixed, under heat and pressure application, on the recording material 2 by a fixing means 5 and thereafter the recording material 2 is discharged to a discharge portion 6.

(Process Cartridge)

Next, with reference to (a) and (b) of FIG. 2, the process cartridge B will be described. Part (b) of FIG. 2 is a sectional view for illustrating a general arrangement of the process cartridge B in this embodiment.

The process cartridge B is constituted by rotatably connecting a developing cartridge C and a drum cartridge D relative to each other and is detachably mounted to a main assembly of the image forming apparatus A (hereinafter referred to as an apparatus main assembly). The developing cartridge C is constituted by a developing means constituted by the toner (not shown), a developing roller 12, a toner supplying roller 16 and the like, and a developing cartridge frame 8 for accommodating the toner and supporting the developing means. Further, the drum cartridge D is constituted by constituent members such as the photosensitive drum 7 and a cleaning blade 14 and by a drum cartridge frame 13 for supporting these constituent members.

The toner accommodated in a toner accommodating portion 9 of the developing cartridge C is sent to a developing chamber 10. Further, a toner layer is formed on the surface of the developing roller 12 by a toner supplying roller 16 and a developing blade 11 which are provided at a periphery of the developing roller 12. The toner supplying roller 16 is rotated in an arrow E direction shown in (b) of FIG. 2 in contact with the developing roller 12, and the developing blade 11 regulates the toner layer. Then, the toner formed on the surface of the developing roller 12 is transferred onto the photosensitive drum 7 correspondingly to the latent image formed on the photosensitive drum 7, so that the toner image is formed on the photosensitive drum 7. Then, after the toner image on the photosensitive drum 7 is transferred onto the recording material 2 by the transfer roller 4, the toner remaining on the photosensitive drum 7 is scraped off by the cleaning blade 14, so that the residual toner is collected (removed) in a residual toner accommodating portion 15. Thereafter, the surface of the photosensitive drum 7 is uniformly charged by a charging roller 18 as a charging means (process means), so that a latent image formable state by the optical system 1 is created.

(Developing Cartridge)

A general structure of the developing cartridge will be described with reference to (b) of FIG. 2, (a) and (b) of FIG. 3 and (a) and (b) of FIG. 4.

Part (a) of FIG. 3 is a schematic perspective view showing a structure of the developing cartridge C in a state in which the process cartridge B is mounted in the main assembly of the image forming apparatus A, and (b) of FIG. 3 is a partial sectional view of the developing cartridge C shown in (a) of FIG. 3. Part (a) of FIG. 4 is a schematic side view showing a structure of a bearing member for the developing cartridge C and its peripheral portion, and (b) of FIG. 4 is a partial perspective view showing the structure of the bearing member for the developing cartridge C and its peripheral portion, taken along X-X line indicated in (a) of FIG. 4.

As shown in (b) of FIG. 2 and FIG. 3, the developing cartridge C includes the developing roller 12, the developing cartridge frame 8 and a bearing (bearing unit) F. The developing roller 12 is rotatably provided and is disposed in contact with the photosensitive drum 7. The developing roller 12 is supported rotatably by the developing cartridge frame 8 via the bearing F.

The bearing F rotatably supporting the developing roller 12 is constituted by a bearing member 20 as a bearing frame molded with a resin material as described later and a contact portion 19 as an electrode member. Further, the bearing F is mounted at each of longitudinal ends of the developing cartridge frame 8. In (a) of FIG. 3, of the bearings F mounted at the longitudinal ends of the developing cartridge frame 8, a left-side bearing member is represented by 20L, and a right-side bearing member is represented by 20R.

At the periphery of the developing roller 12, the toner supplying roller 16 and the developing blade 11 are disposed.

The toner supplying roller 16 supplies the toner to the developing roller 12 and is rotated in contact with the developing roller 12 in order to remove the toner from the developing roller 12. The developing blade 12 is used for regulating the toner layer on the developing roller 12. The developing cartridge C is urged toward the drum cartridge D by an urging spring 39 and therefore is in a state in which the developing roller 12 is contacted to the photosensitive drum 7.

(Electrode Constitution of Developing Cartridge and Voltage Applying Method)

Figure 1:
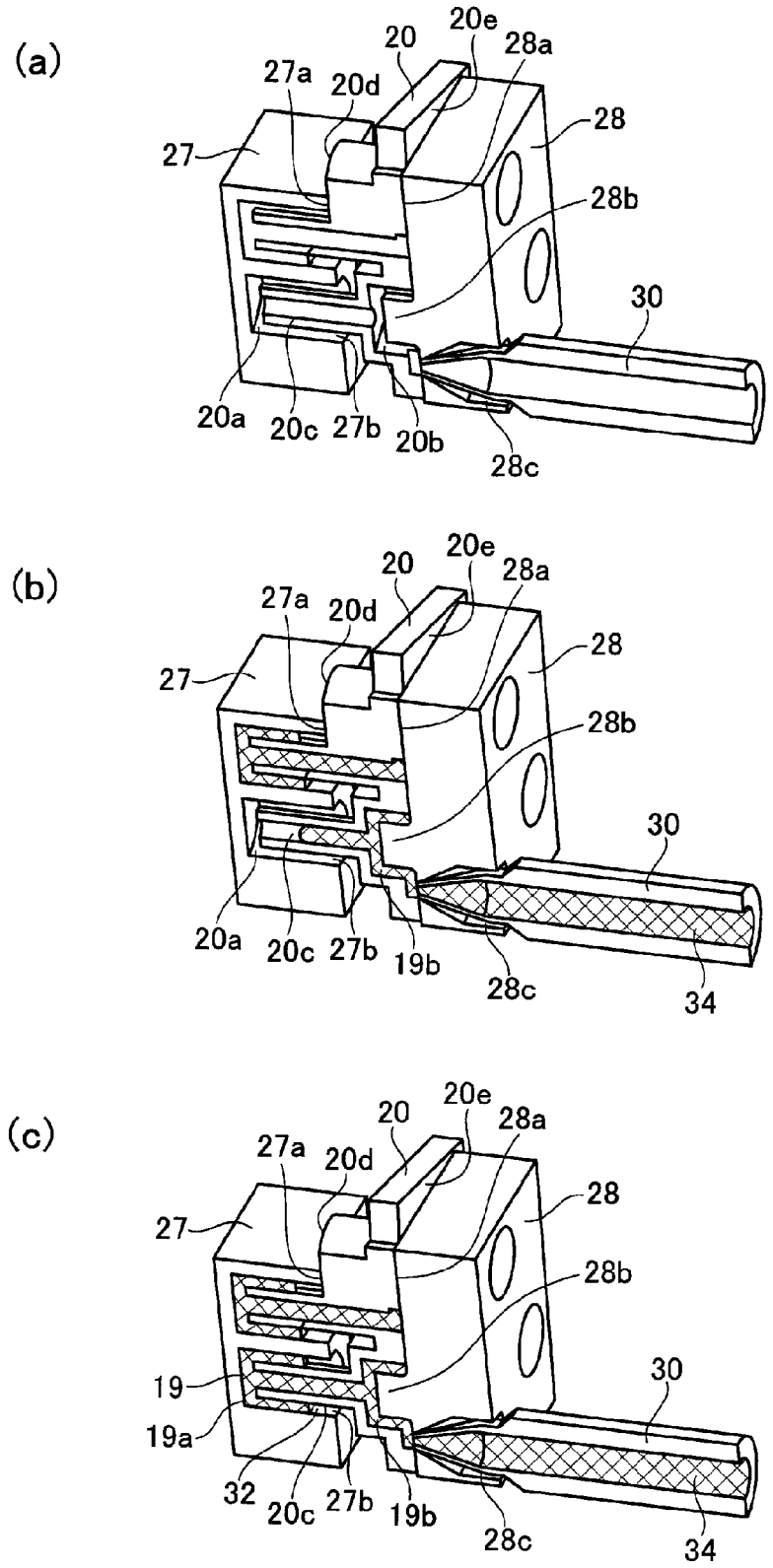

With reference to FIGS. 3, 4 and 13, a method of supplying electric energy to the developing roller 12 and the toner supplying roller 16 will be described. In this embodiment, a constitution of voltage application to the developing roller 12 and a constitution of voltage application to the toner supplying roller 16 are the same and therefore the constitution of voltage application to the developing roller 12 will be described as an example. The developing roller 12 is a member to be supplied with electric energy which is rotatably provided and which is to be electrically connected to a main assembly electrode 21 as an electric contact provided in the main assembly of the image forming apparatus A. Although described later, the contact portion 19 is formed by injecting an electroconductive resin material into a spacing (space) created when the bearing member 20 is sandwiched between molds 27 and 28 (FIG. 1). Thus, the contact portion 19 is molded by injecting the electroconductive resin material into the space between the bearing member 20 and the molds contacted to the bearing member 20, thus electrically connecting the developing roller 12 and the main assembly electrode 21 of the main assembly of the image forming apparatus A. Similarly as in the case of the contact portion 19, a toner supplying roller electrode 17 for electrically connecting the toner supplying roller 16 and the main assembly electrode 21 of the main assembly of the image forming apparatus A.

Parts (a) to (f) of FIG. 13 are schematic views for illustrating the bearing member 20 which is parted from the molds and which is provided with the molded contact portion 19.

As shown in FIG. 13, the contact portion 19 is integrally molded with the bearing member 20. A specific molding method will be described later. As a result, the bearing F is constituted. The contact portion 19 includes a core metal supporting portion 19*b* as a first contact portion and a contact surface 19*a* as a second contact portion. The contact surface 19*a* is exposed in one surface side of the bearing member 20.

Then, as shown in FIG. 3, when the process cartridge B is mounted in the main assembly of the image forming apparatus A, the main assembly electrode 21 of the main assembly of the image forming apparatus A and the contact surface 19*a* of the contact portion 19, formed of an electroconductive resin material 34 (FIG. 1), integrally molded with the bearing member 20 of the bearing F are contacted to each other.

On the other hand, the core metal supporting portion 19*b* is exposed in another surface side of the bearing member 20 opposite from the contact surface 19*a*. The core metal supporting portion 19*b* rotatably supports a core metal end portion 12*b* of the developing roller 12 and contacts a peripheral surface of the core metal end portion 12*b* and an end surface 12*c*.

After the process cartridge B is mounted in the image forming apparatus A, when a voltage is outputted to the main assembly electrode 21 in accordance with a command from a controller (not shown) of the main assembly of the image forming apparatus A, the voltage is applied to the surface of the developing roller 12. At this time, the voltage is applied from the main assembly electrode 21 to the surface of the developing roller 12 via the contact surface 19*a*, the core metal supporting portion 19*b* and the core metal end portion 12*b*. Thus, the contact portion 19 is provided for electrically connecting the developing roller 12 and the main assembly electrode 21.

In this embodiment, the main assembly electrode 21 and the contact portion 19 are directly connected but may also be electrically connected indirectly via another electroconductive member therebetween.

Next, another constitution for supporting the developing roller 12 will be described with reference to (a) and (b) of FIG. 18.

Parts (a) and (b) of FIG. 18 are schematic sectional views each showing an end portion of the developing roller 12 and a peripheral portion of the contact portion 19, in which (a) shows a state before assembling of the developing roller 12 with the bearing F, and (b) shows a state after completion of the assembling.

As shown in (a) of FIG. 18, the contact portion 19 molded integrally with the bearing member 20 includes the core metal supporting portion 19*b* contactable with the core metal end portion 12*b* of the developing roller 12 and the contact surface 19*a* contactable with the main assembly electrode 21. In this case, the core metal supporting portion 19*b* has a projected shape 19*ba* projected toward the inside of the process cartridge B. Further, the core metal end portion 12*b* of the developing roller 12 is provided with a recessed shape 12*ca* at its edge.

As shown in (b) of FIG. 19, the bearing F and the developing roller 12 are assembled with the process cartridge B, so that the projected shape 19*ba* is inserted into the recessed shape 12*ca* to contact the core metal end portion 12*b*, thus being configured to support the core metal end portion 12*b*. As a result, the bearing F can support the developing roller 12. In such a constitution, the core metal supporting portion 19*a* not only supports the core metal end portion 12*b* of the developing roller 12 but also is electrically connected with the core metal end portion 12*b*.

(Bearing Member)

The shape of the bearing member 20 will be described with reference to FIGS. 4, 5 and 13.

Parts (a) and (b) of FIG. 5 are schematic views of an outer appearance of front side and rear side, respectively, of the bearing member 20. Part (c) of FIG. 5 is a sectional view showing the bearing member 20. Parts (d) and (f) of FIG. 5 are partial perspective views showing the bearing member 20 corresponding to (a) and (b) of FIG. 5, respectively, taken along Y-Y line indicated in (c) of FIG. 5. Part (f) of FIG. 5 is a sectional view showing the bearing member 20 when the bearing member 20 is cut along the Y-Y line in (c) of FIG. 5.

The bearing member 20 includes a contact portion-forming portion 20*a* where the contact surface 19*a* of the contact portion 19 is to be molded and a cone metal supporting portion-forming portion 20*b* where the core metal supporting portion 19*b* is to be molded. Further, the bearing member 20 includes a mold contact surface 20*d* to which a mold 27 is to be contacted when the contact portion 19 is molded and a mold contact surface 20*e* to which a mold 28 is to be contacted. The core metal supporting portion-forming portion 20*b* has a shape such that it is recessed from the mold contact surface 20*e* with the mold 28 (FIG. 7) with respect to the longitudinal direction of the process cartridge B (toward a side opposite to an arrow N direction in (f) of FIG. 5). The bearing member 20 has a tunnel shape 20*c*, and an inner space of the tunnel shape 20*c* is a through hole provided in a wall surface having end surfaces 20*f* and 20*g* ((f) of FIG. 5) of the contact portion-forming portion 20*a* and the core metal supporting portion-forming portion 20*b*, respectively.

(Contact Surface Forming Mold)

With reference to FIGS. 4 and 6, the mold 27 for forming the contact surface 19*a* of the contact portion 19 will be described. FIG. 6 is a perspective view showing the mold 27, which is one of the two molds to be contacted to the bearing member 20, used when the contact surface 19*a* of the contact portion 19 is formed.

The mold 27 for forming the contact surface 19*a* is provided with a contact surface 27*a* to be abutted against the bearing member 20 and a depression (recess) 27*b* where the contact surface 19*a* is to be molded. FIG. 6 shows the mold 27, as an example, configured to be capable of permitting formation of the contact surface 19*a* at three positions.

(Core Metal Supporting Portion Forming Mold)

With reference to FIGS. 4 and 7, the mold 28 for forming the core metal supporting portion 19*b* of the contact portion 19 will be described. FIG. 7 is a perspective view showing the mold 27, which is the other one of the two molds to be contacted to the bearing member 20, used when the core metal supporting portion 19*b* of the contact portion 19 is formed.

The mold 27 for forming the core metal supporting portion 19*b* is provided with a contact surface 28*a* to be abutted against the bearing member 20, a projection 28*b* for permitting molding of an inner diameter portion of the core metal supporting portion 19*b*, and an inject port 28*c* into which a gate 30 for injection of an electroconductive resin material is to be inserted. FIG. 7 shows the mold 27, as an example, configured to be capable of permitting formation of the core metal supporting portion 19*b* at three positions.

(Contact Portion Forming Method)

A forming method of the contact surface 19*a* and the core metal supporting portion 19*b* will be described with reference to FIGS. 1, 4, 5, 6, 7, 8, 9, 11 and 13. Parts (a) to (c) of FIG. 1 are schematic sectional views showing an operation of injection of the electroconductive resin material from the contact of the molds 27 and 28 with the bearing member 20 to completion of the injection in a time-series manner. Parts (a) to (d) of FIG. 8 are schematic perspective views showing a state until the molds 27 and 28 are contacted to the bearing member 20 in a time-series manner. FIG. 11 is a sectional view showing a state in which the electroconductive resin material is injected into the bearing member 20 and the gate is retracted, and is also a schematic view for illustrating a buffer portion described later.

First, as shown in (a) of FIG. 8, the mold 28 is contacted to the bearing member 20 (in an arrow direction in the figure). At this time, the contact surface 28*a* of the mold 28 is abutted against the contact surface 20*e* of the bearing member 20.

Next, as shown in (b) of FIG. 8, the mold 27 is contacted to the bearing member 20 (in an arrow direction in the figure). At this time, the contact surface 27*a* of the mold 27 is abutted against the contact surface 20*d* of the bearing member 20. A state in which the two molds 27 and 28 are contacted to the bearing member 20 to sandwich the bearing member 20 therebetween is (c) of FIG. 8.

At this time, as shown in (a) of FIG. 1, a spacing between the mold 27 and an outer peripheral surface of the tunnel shape 20*c* and a spacing between the mold 27 and the tunnel shape 20*c* with respect to the longitudinal direction of the process cartridge constitute the contact portion-forming portion 20*a*. Further, a spacing between the projection 28*b* of the mold 28 and the bearing member 20 constitutes the core metal supporting portion-forming portion 20*b*.

Next, as shown in (a) of FIG. 1 and (d) of FIG. 8, the gate 30 for permitting the injection of the electroconductive resin material 34 is inserted into the inject port 28*c* of the mold 28 (in an arrow direction in (d) of FIG. 8) after the molds 27 and 28 are contacted to the bearing member 20, thus being abutted against a rear end of the inject port 28*c*. In this case, the gate 30 and the mold 28 may also be integrally molded originally.

Thereafter, as shown in (b) of FIG. 1, the electroconductive resin material 34 is injected from the gate 30 into the core metal supporting portion-forming portion 28*b* via the injection port 28*c*.

Then, the electroconductive resin material 34 passes through the inner space of the tunnel shape 20*c* of the bearing member 20 to reach the electroconductive resin material 34. The electroconductive resin material 34 flowing out from the tunnel shape 20*c* enters the contact portion-forming portion 20*a* to fill the spacing between the mold 27 and the tunnel shape 20*c*.

When the injection is completed, mold opening is made. Thus, the electroconductive resin material 34 is integrally molded with the bearing member 20, so that the bearing F is prepared.

In the thus-prepared bearing F, as shown in FIGS. 4 and 13, the electroconductive resin material entering the contact portion-forming portion 20*a* forms the contact surface 19*a*, and the electroconductive resin material entering the core metal supporting portion-forming portion 20*b* forms the core metal supporting portion 19*b*.

An inner diameter surface of the core metal supporting portion 19*b* rotatably supports the core metal end portion 12*b* of the developing roller 12 when the developing roller 12 is assembled. Further, the end surface of the core metal supporting portion 19*b* and the inner diameter surface of the core metal supporting portion 19*b* constitute the contact portion for electrically connecting the developing roller 12 and the contact portion 19. Thus, the contact surface 19*a* and the core metal supporting portion 19*b* are integrally molded with the bearing member 20 by passing the electroconductive resin material 34 through a flow passage (in the order of the gate 30, the injection port 28*c*, the core metal supporting portion-forming portion 20*b*, the inner space of the tunnel shape 20*c* and the contact portion-forming portion 20*a*) to be molded. A resin material portion molded by being penetrated through the inner space (through hole) of the tunnel shape 20*c* corresponds to a penetration portion of the electrode member.

At the contact portion 19, a position where the contact portion 19 opposes the gate 30 through which the electroconductive resin material 34 is to be injected is located in the core metal supporting portion 19*b* formation side. This is because the shape of the core metal supporting portion 19*b* is required to be created with high accuracy and therefore a position closer to the gate permits a higher injection pressure and the higher injection pressure can ensure a higher degree of accuracy.

Although described later, in the case where the higher degree of accuracy is required, compared with a constitution in which a different material is injected later, two-color molding is preferable since it is performed without taking out a molded product from the mold. The two-color molding is a molding method in which a first color resin material (for the bearing member 20 in this embodiment) is injected and molded and thereafter a second color resin material (corresponding to the electrode member 34 in this embodiment) is injected and molded without taking out the molded product of the first color resin material from the mold, and then a resultant molded product is parted from the mold.

Part (c) of FIG. 1 is a perspective view showing a state in which the injection of the electroconductive resin material 34 is completed.

As shown in FIG. 11, at a flow passage terminal 19*aa* of the contact surface 19*a* for the resin material 34 during the molding, a buffer portion 32 for absorbing an excessive resin material generated due to component (part) tolerance and a variation in injection amount of the electroconductive resin material 34 is provided. The buffer portion 32 will be described later.

An electrical connecting path from the core metal supporting portion 19*b* to the contact surface 19*a* is surrounded by the tunnel shape 20*c*. For that reason, in the case where a plurality of contact portions 19 are provided on the bearing F, it is possible to alleviate a possibility that a voltage failure such as a short circuit caused by creepage distance and spatial distance between connecting paths for the respective contact portions.

The creepage distance refers to a distance b (thick line in (f) of FIG. 13) from a electroconductive end surface b1 molded as shown in (f) of FIG. 13 to another electroconductive resin material end surface b2 along the shape of the bearing member 20 (at a minimum distance). The spatial distance refers to a spatial rectilinear line distance (minimum distance a in (f) of FIG. 13) from the molded electroconductive resin material and the molded another electroconductive resin material. When these distances a and b are not ensured sufficiently, a bias applied to the electroconductive resin material is leaked to another electroconductive resin material, so that there is a possibility that a set value of the applied bias is changed.

Next, the parting will be described.

Parts (a) to (d) of FIG. 9 are perspective views for illustrating an operation of the parting after the injection of the resin material for forming the bearing F is completed, in a time-series manner.

First, as shown in (a) of FIG. 9, the gate 30 is retracted from the injection part 28*c* of the mold 28 (in an arrow direction in the figure). Part (b) of FIG. 9 shows a state in which the gate 30 is retracted. Next, as shown in (c) of FIG. 9, the mold 27 is parted from the bearing member 20 (in an arrow direction in the figure). Finally, as shown in (d) of FIG. 9, the mold 28 is parted from the bearing member 20 (in an arrow direction in the figure). As a result, a state in which the contact portion 19 (including the contact surface 19*a* and the core metal supporting portion 19*b*) is integrally formed with the bearing member 20 is formed.

(Functions and Retaining of Shapes of Contact Portion and Prevention of Jerky Between Parts)

Next, with reference to FIGS. 5, 10 and 13, retaining (anchor shape) of the molded contact portion 19 will be described.

Parts (a) to (d) of FIG. 10 are perspective views for illustrating functions of the contact portion 19 for which the parting is completed and the molding is ended, in which the bearing member 20 is not shown.

As shown in (a) and (b) of FIG. 10, the contact portion 19 includes the contact surface 19*a*, the core metal supporting portion 19*b* and the buffer portion 32. Further, as shown in (c) and (d) of FIG. 10, when the process cartridge B is mounted in the main assembly of the image forming apparatus A, the in assembly electrode 21 is contacted to the contact surface 19*a*. When the developing roller 12 is assembled, the core metal end portion 12*b* of the developing roller 12 is contacted to the core metal supporting portion 19*b*, so that the core metal end portion 12*b* is rotatably supported by the core metal supporting portion 19*b*.

By such a constitution, a conduction path from the main assembly electrode 21 to the core metal end portion 12*b* of the developing roller 12.

The reason why such a constitution is employed is that the bearing member 20 and the contact portion 19 are formed of different materials and therefore there is a possibility that they do not intimately contact each other to cause floating and dropping-off.

Further, as shown in (f) of FIG. 5 and (f) of FIG. 13, at the contact portion 19, a rear-side surface diameter 19*d* of the contact surface 19*a* and a rear-side surface diameter 19*e* of the core metal supporting portion 19*b* are larger than an inner diameter 19*c* of the tunnel shape 20*c*. As a result, even when a force is applied to the contact portion 19 in an arrow N direction, the surface with the surface diameter 19*d* is contacted to a surface 20*g* of the bearing member 20 and the surface with the surface diameter 19*e* is contacted to a surface 20*f* of the bearing member. This is also true for opposite direction. For this reason, it is possible to prevent the floating and dropping-off of the contact portion from the bearing member 20.

Thus, by forming the contact portion 19 so as to sandwich the portions of the bearing member 20, even in the case where impact is applied to the process cartridge B during transportation or the like, it is possible to prevent the contact portion 19 from being dropped off from the bearing member 20 and from being floated from the bearing member 20.

In this embodiment, the contact portion 19 is molded to block end portion holes (through hole) of the tunnel shape 20*c* but is not limited thereto so long as the contact portion 19 is molded to prevent the floating and dropping-off thereof from the bearing member 20. For example, an anchor portion (flange portion or projection) projected toward the outer diameter side from the end portion holes (through hole) of the tunnel shape 20*c* may preferably be provided so as to sandwich the portion (the wall surface with the end surfaces 20*f* and 20*g*) of the bearing member 20.

In the case where the contact portion 19 has a planar configuration with no anchor portion, when a force is applied in one direction, there is a possibility that the contact portion 19 is dropped off from the bearing member 20. For that reason, as described above, by providing the contact portion 19 with a three-dimensional structure, even when the force is applied in any direction, the contact portion 19 can perform a retaining function capable of preventing the jerky (floating) and the dropping-off.

In this embodiment, a high-impact polystyrene resin material with a shrinkage rate of 0.6% is used as the resin material for the bearing member 20, and an electroconductive polyacetal resin material with the shrinkage rate of 1.2% is used as the electroconductive resin material 34.

Then, in this embodiment, the molding of the contact portion 19 is made by injecting the electroconductive resin material 34 after the molding of the bearing member 20, thus integrally molding the resin material for the bearing member 20 and the electroconductive resin material 34. Particularly, in this embodiment, during the molding of the contact portion 19, the electroconductive resin material 34 is injected before the (melted) resin material for molding the bearing member 20 is completely cooled to be solidified, so that the electroconductive resin material 34 is integrally molded with the resin material for the bearing member 20 to prepare the bearing F.

For this reason, based on a difference in shrinkage rate (a larger shrinkage rate of the resin material injected later), the electroconductive resin material 34 sandwiches and clamps the bearing member 20.

In such a constitution in which the bearing member is sandwiched by the electroconductive resin material 34 based on the shrinkage of the electroconductive resin material 34 after the molding, the contact portion is not readily disconnected from the bearing member 20. That is, the contact surface 19*a* and the core metal supporting portion 19*b* which sandwich the bearing member 20 (the wall surface with the end surfaces 20*g* and 20*f*) are shrunk in arrow directions shown in (f) of FIG. 13 and therefore the contact portion 19 is satisfactorily connected to the bearing member 20, thus being not readily disconnected form the bearing member 20.

Thus, in this embodiment, the constitution in which the electroconductive resin material 34 is injected into the bearing member 20 to mold the contact portion 19 integrally with the bearing member 20 is employed and therefore compared with a constitution in which parts are assembled with each other, it is possible to more prevent the jerky between the parts.

In this embodiment, as the resin material for the contact portion 19, a polyacetal resin material containing carbon black in an amount of about 10% is used. By the use of carbon black, damage (abrasion or the like) on a manufacturing device can be minimized. So long as the damage on the manufacturing device can be minimized, the additive is not limited to carbon black but may also be carbon fibers, other metal-based additives, and the like.

(Clamping and Back-Up)

Clamping performed in a step of forming the contact surface 19*a* and the core metal supporting portion 19*b* will be described with reference to Figures (c) of FIG. 8 and FIG. 12.

Part (c) of FIG. 8 is a schematic perspective view showing a state in which the bearing member 20 is clamped by bringing the molds 27 and 28 into contact with the bearing member 20. FIG. 12 is a schematic sectional view for illustrating resin pressure.

When the contact portion 19 is molded, the contact surface 27*a* of the mold 27 is contacted to the mold contact surface 20*d* of the bearing member 20 to perform the clamping. Further, the contact surface 28*a* of the mold 28 is contacted to the mold contact surface 20*e* of the bearing member 20 to perform the clamping.

In this embodiment, during the mold clamping, the bearing member 20 is sandwiched between the molds 27 and 28, so that the mold contact surfaces 20*d* and 20*e* of the bearing member 20 are supported by the molds 27 and 28, respectively. This is because the mold contact surfaces 20*d* and 20*e* of the bearing member 20, the contact surface 27*a* of the mold 27 and the contact surface 28*a* of the mold 28 are not moved (deviated) by and the bearing member 20 is not deformed by urging forces of the molds 27 and 28 and resin pressure P during the resin material injection.

In this embodiment, during the mold clamping, the mold contact surfaces 20*d* and 20*e* are supported but supporting portions are not limited thereto. That is, the supporting portions may be a portion where the movement and deformation of the bearing member 20 can be suppressed by supporting the bearing member 20.

(Buffer Portion)

Next, the buffer portion 32 of the contact portion 19 will be described with reference to (c) of FIG. 1 and FIG. 11. As shown in (c) of FIG. 1 and FIG. 11, in the bearing member 20, at a terminal portion in a downstream side of the injection path of the electroconductive resin material 34 injected from the injection port 28*c* to the contact portion-forming portion 20*a*, the buffer portion 32 is provided.

The buffer portion 32 functions as an accommodating portion for absorbing (accommodating) an excessive resin material so as not to cause a problem in the molding even when the flow path terminal portion 19*aa* is moved in an arrow N direction due to a decrease in resin material injection space by the component tolerance and due to the variation in resin material injection amount. The buffer portion 32 ranges in a space from the flow path terminal portion 19*aa*, where the injection amount of the electroconductive resin material 34 is proper, to the contact surface 27*a* of the mold 27 in the arrow N direction shown in FIG. 11.

In this embodiment, the buffer portion 32 is provided at the terminal portion in the downstream side of the resin material injection path but the present invention is not limited thereto. The buffer portion 32 may also be provided at an intermediate portion of the resin material injection path. That is, the buffer portion 32 may only be required to be provided at a position where the buffer portion 32 is integrally molded with the bearing member 20 so that the buffer portion 32 can accommodate (retain) the resin material coming out of the contact portion-forming portion 20*a*.

(Two-Color Molding)

Next, the above-described two-color molding will be described specifically with reference to (a) to (d) of FIG. 14.

Parts (a) to (d) of FIG. 14 are schematic sectional views for illustrating the case where the bearing F having a simple shape is manufactured by the two-color molding by using molds 22, 23 and 25 for a first color and molds 23, 24 and 25 for a second color. Part (a) of FIG. 14 shows a state of connection of the molds 22, 23 and 25. Part (b) of FIG. 14 shows a state in which the first color resin material (for the bearing member 20) is molded. Part (c) of FIG. 14 shows a state in which the mold 22 is replaced with the mold 24. Part (d) of FIG. 14 shows a state in which the second color resin material (for the contact portion 19) is molded.

In the two-color molding, first, as shown in (a) of FIG. 14, the molds 22, 23 and 25 are connected for molding the first color resin material for the bearing member 20, thus forming a resin material injection space. Then, as shown in (b) of FIG. 14, the resin material for the bearing member 20 is injected into the space in the molds, thus being molded as the bearing member 20. Next, as shown in (c) of FIG. 14, the mold 22 is replaced with the mold 24, and the mold 25 is retracted in an arrow direction in a distance corresponding to a thickness of the contact surface 19*aa* to be formed, thus forming a space into which the electroconductive resin material 34 is to be injected. Finally, as shown in (d) of FIG. 14, the electroconductive resin material 34 is injected from the injection port 24*a* of the mold 24 into the space, thus being molded as the contact portion 19.

By using the two-color molding, the injection pressure can be increased and thus by the increase in injection pressure, the contact portion 29 can be shaped with high accuracy.

Next, with reference to FIGS. 14 and 15, the contact portion 19 and the bearing member 20 which are molded by the two-color molding will be described.

Part (a) of FIG. 15 is a perspective view showing an outer appearance of the contact portion 19 and the bearing member 20 which are integrally molded by the two-color molding described with reference to FIG. 14. Part (B) of FIG. 15 is a plan view showing the integrally molded contact portion 19 and bearing member 20. Part (c) of FIG. 15 is a schematic sectional view of the contact portion 19 and the bearing member 20 taken along V-V line indicated in (b) of FIG. 15.

As shown in FIG. 15, the contact portion 19 is not provided with the buffer portion 32 (FIG. 11) at a corresponding to the resin material flow path terminal portion 19*aa*. This is because the resin material injection amount is adjusted by the resin material injection device and therefore the buffer portion 32 is not required to be provided.

Also in the molding method in this case, the electroconductive resin material 34 is configured to sandwich the bearing member 20 between the contact surface 19*a* and the core metal supporting portion 19*b*. That is, as shown in (c) of FIG. 15, the contact surface 19*a* and the core metal supporting portion 19*b* between which the bearing member 20 is sandwiched as shrunk in arrow directions in the figure, so that the contact portion 19 clamps (fastens) the bearing member 20. As a result, the contact portion 19 and the bearing member 20 are fixed firmly, so that it is possible to prevent the floating and the dropping-off which can occur between the contact portion 19 and the bearing member 20.

(Gate Position)

A gate position will be described with reference to (a) and (b) of FIG. 16. Part (a) of FIG. 16 is a perspective view showing the case where the contact portion 19 is molded after the molding of the bearing member and corresponds to those of FIG. 13. Part (b) of FIG. 16 is a perspective view showing the case where the bearing F is molded by the two-color molding and corresponds to those of FIG. 15.

Even in the case where the bearing member 20 after being molded is engaged in the mold for molding the contact portion 19 and then the contact portion 19 is molded or in the case where the bearing F is molded by the two-color molding, the gate position 19*f* is located in the core metal supporting portion 19*b* side. By employing such a constitution, it is possible to improve accuracy of the inner diameter of the core metal supporting portion 19*b*. This is because the injection pressure is higher when the core metal supporting portion 19*b* is closer to the gate, and thus the injected resin material is strongly pressed against the metal mold.

(Recycling)

In the case where the bearing member 20 and the contact portion 19 which are in an integral unit state are separated, they can be separated by being crushed in a crusher, thus being subjected to fractional recycling.

As described above, according to Embodiment 1, different from the conventional constitution, there is no need to provide an inserting port, a positioning hole, a cut-away portion, and the like for mounting the electric contact portion to the bearing member, so that it becomes possible to form the electroconductive path without lowering the strength (rigidity) of the bearing member (frame) to the possible extent. Further, in this embodiment, the electroconductive path is formed by providing the hole (through hole) penetrating through a space between the contact portion-forming portion 20*a* and the core metal supporting portion-forming portion 20*b* but the electroconductive resin material is injected in the through hole, so that the through hole can be filled with the electroconductive resin material. As a result, the strength of the bearing member can be ensured.

Further, compared with the conventional constitution shown in FIG. 19, when a plurality of contact members are required, the creepage distance and the spatial distance can be ensured by the thickness of the tunnel shape and therefore the connecting path of the contact members becomes simple. Further, easy connection of the electroconductive path is enabled, so that a connecting space can be reduced and thus downsizing of the process cartridge with respect to the longitudinal direction can be realized.

Further, by forming the contact portion by the injection of the electroconductive resin material, a complicated electrode shape can be formed, so that a degree of design freedom of the contact portion (electroconductive path) can be enhanced.

Further, the contact portion is formed by sandwiching the bearing member and even when impact is applied to the process cartridge during transportation or the like, by the anchor shape, it is possible to prevent generation of phenomena such that the contact portion is dropped off from the bearing member and such that the contact portion is floated from the bearing member.

Further, an assembling constitution between parts such as the electric contact part (metal plate) and the bearing member is not employed and therefore positional accuracy of the electric contact portion relative to the bearing member can be precisely ensured, so that the jerky between the bearing member and the contact portion can be prevented.

Here, the contact portion 19 in this embodiment electrically connects each of the developing roller 12 and the toner supplying roller 16 with the main assembly electrode 21 in the developing cartridge C but the present invention is not limited thereto. The contact portion 19 may also electrically connect, e.g., the photosensitive drum 7 and the main assembly of image forming apparatus A in the drum cartridge D. Further, the contact portion 19 may also be provided correspondingly to each of the photosensitive drum 7 and the charging roller 18. That is, the contact portion for electrically connecting the charging roller 18 and the main assembly of the image forming apparatus A, and the contact portion for electrically connecting the photosensitive drum 7 and the main assembly of the image forming apparatus A may also be provided. Further, in the case where the present invention is applied to the process cartridge B as described above, the contact portion may also be provided in a plurality of electrode portions correspondingly to the photosensitive drum 7 and the plurality of recording material. Further, in this embodiment, as a structure for supporting the core metals of the developing roller 12 and the toner supplying roller 16, the core metal supporting portion 19*b* is described but the present invention is not limited thereto. Any portion for supporting a slidable member may also be used.

Further, in this embodiment, the constitution in which the contact portion 19 is provided with the core metal supporting portion 19*b* for being contacted to rotatable members such as the developing roller 12 and the toner supplying roller 16 which are the process means was described. However, the contact portion may also electrically connecting a constituent member, other than the rotatable members, with the main assembly of the image forming apparatus A.

Parts (a) to (c) of FIG. 17 are schematic views showing a process means, other than the rotatable members, contactable to the contact portion. In these figures, the developing blade 11 contacts, at a developing blade end surface 11*a*, a developing blade contact portion 31 provided on the bearing F (bearing member 20). By employing such a constitution, also to the process means other than the rotatable members, the voltage can be applied.

Embodiment 2

A developing cartridge in Embodiment 1 will be described. The image forming apparatus in this embodiment is the same as that in Embodiment 1, thus being omitted from description. Similarly, the cross-sectional shape of the developing cartridge in this embodiment is the same as that in Embodiment 1 and therefore (b) of FIG. 12 is also referred to in this embodiment.

(Developing Cartridge)

A general structure of the developing cartridge will be described with reference to (b) of FIG. 2, (a) and (b) of FIG. 20 and (a) and (b) of FIG. 21.

Part (a) of FIG. 20 is a schematic perspective view showing a structure of the developing cartridge C in a state in which the process cartridge B is mounted in the main assembly of the image forming apparatus A, and (b) of FIG. 20 is a partial sectional view of the developing cartridge C shown in (a) of FIG. 20. Part (a) of FIG. 21 is a schematic side view showing a structure of a bearing member for the developing cartridge C and its peripheral portion, and (b) of FIG. 21 is a partial perspective view showing the structure of the bearing member for the developing cartridge C and its peripheral portion, taken along X-X line indicated in (a) of FIG. 21.

As shown in (b) of FIG. 2 and FIG. 20, the developing cartridge C includes the developing roller 12, the developing cartridge frame 8 and a bearing (bearing unit) F. The developing roller 12 is rotatably provided and is disposed in contact with the photosensitive drum 7. The developing roller 12 is supported rotatably by the developing cartridge frame 8 via the bearing F.

The bearing F rotatably supporting the developing roller 12 is constituted by a bearing member 20 as a bearing frame molded with a resin material as described later and a contact portion 19 as an electrode member. Further, the bearing F is mounted at each of longitudinal ends of the developing cartridge frame 8. In (a) of FIG. 20, of the bearings F mounted at the longitudinal ends of the developing cartridge frame 8, a left-side bearing member is represented by 20L, and a right-side bearing member is represented by 20R.

At the periphery of the developing roller 12, the toner supplying roller 16 and the developing blade 11 are disposed. The toner supplying roller 16 supplies the toner to the developing roller 12 and is rotated in contact with the developing roller 12 in order to remove the toner from the developing roller 12. The developing blade 12 is used for regulating the toner layer on the developing roller 12. The developing cartridge C is urged toward the drum cartridge D by an urging spring 39 and therefore is in a state in which the developing roller 12 is contacted to the photosensitive drum 7.

(Electrode Constitution of Developing Cartridge and Voltage Applying Method)

With reference to FIGS. 20, 21 and 33, a method of supplying electric energy to the developing roller 12 and the toner supplying roller 16 will be described. In this embodiment, a constitution of voltage application to the developing roller 12 and a constitution of voltage application to the toner supplying roller 16 are the same and therefore the constitution of voltage application to the developing roller 12 will be described as an example. The developing roller 12 is a member to be supplied with electric energy which is rotatably provided and which is to be electrically connected to a main assembly electrode 21 as an electric contact provided in the main assembly of the image forming apparatus A. Although described later, the contact portion 19 is formed by injecting an electroconductive resin material into a spacing (space) created when the bearing member 20 is sandwiched between molds 27 and 28 (FIG. 32). Thus, the contact portion 19 is molded by injecting the electroconductive resin material into the space between the bearing member 20 and the molds contacted to the bearing member 20, thus electrically connecting the developing roller 12 and the main assembly electrode 21 of the main assembly of the image forming apparatus A. Similarly as in the case of the contact portion 19, a toner supplying roller electrode 17 as an electroconductive path for electrically connecting the toner supplying roller 16 and the main assembly electrode 21 of the main assembly of the image forming apparatus A.

Parts (a) to (f) of FIG. 33 are schematic views for illustrating the bearing member 20 which is parted from the molds and which is provided with the molded contact portion 19.

As shown in FIG. 23, the contact portion 19 is integrally molded with the bearing member 20. A specific molding method will be described later. As a result, the bearing F is constituted. The contact portion 19 includes a penetrating portion 19*f* which penetrates through a through hole 20*c* described later, a first contact portion 19*b* provided in one end side of the penetrating portion 19*f* with respect to an axial direction of the through hole 20*c*, and a second contact portion 19*a* provided in another end side of the penetrating portion 19*f*. In the following, the first contact portion is referred to as a core metal supporting portion 19*b* as a supporting portion, and the second contact portion is referred to as a contact surface 19*a* as an engaging portion. The contact surface 19*a* is exposed in one surface side of the bearing member 20.

Then, as shown in FIG. 20, when the process cartridge B is mounted in the main assembly of the image forming apparatus A, the main assembly electrode 21 as a main assembly electric contact of the main assembly of the image forming apparatus A and the contact surface 19*a* of the contact portion 19, formed of an electroconductive resin material 34 (FIG. 32), integrally molded with the bearing member 20 of the bearing F are contacted to each other.

On the other hand, the core metal supporting portion 19*b* is exposed in another surface side of the bearing member 20 opposite from the contact surface 19*a*. The core metal supporting portion 19*b* rotatably supports a core metal end portion 12*b* of the developing roller 12 and contacts a peripheral surface of the core metal end portion 12*b* and an end surface 12*c*.

After the process cartridge B is mounted in the image forming apparatus A, when a voltage is outputted to the main assembly electrode 21 in accordance with a command from a controller (not shown) of the main assembly of the image forming apparatus A, the voltage is applied to the surface of the developing roller 12. At this time, the voltage is applied from the main assembly electrode 21 to the surface of the developing roller 12 via the contact surface 19*a*, the core metal supporting portion 19*b* and the core metal end portion 12*b*. Thus, the contact portion 19 is provided for electrically connecting the developing roller 12 and the main assembly electrode 21.

In this embodiment, the main assembly electrode 21 and the contact portion 19 are directly connected but may also be electrically connected indirectly via another electroconductive member therebetween.

Next, another constitution for supporting the developing roller 12 will be described with reference to (a) and (b) of FIG. 31.

Parts (a) and (b) of FIG. 31 are schematic sectional views each showing an end portion of the developing roller 12 and a peripheral portion of the contact portion 19, in which (a) shows a state before assembling of the developing roller 12 with the bearing F, and (b) shows a state after completion of the assembling.

As shown in (a) of FIG. 31, the contact portion 19 molded integrally with the bearing member 20 includes the core metal supporting portion 19*b* contactable with the core metal end portion 12*b* of the developing roller 12 and the contact surface 19*a* contactable with the main assembly electrode 21. In this case, the core metal supporting portion 19*b* has a projected shape 19*ba* projected toward the inside of the process cartridge B. Further, the core metal end portion 12*b* of the developing roller 12 is provided with a recessed shape 12*ca* at its edge.

As shown in (b) of FIG. 31, the bearing F and the developing roller 12 are assembled with the process cartridge B, so that the projected shape 19*ba* is inserted into the recessed shape 12*ca* to contact the core metal end portion 12*b*, thus being configured to support the core metal end portion 12*b*.

As a result, the bearing F can support the developing roller 12. In such a constitution, the core metal supporting portion 19*a* not only supports the core metal end portion 12*b* of the developing roller 12 but also is electrically connected with the core metal end portion 12*b*.

(Bearing Member)

The shape of the bearing member 20 will be described with reference to FIGS. 21, 22 and 33.

Parts (a) and (b) of FIG. 22 are schematic views of an outer appearance of front side and rear side, respectively, of the bearing member 20. Part (c) of FIG. 22 is a sectional view showing the bearing member 20. Parts (d) and (f) of FIG. 22 are partial perspective views showing the bearing member 20 corresponding to (a) and (b) of FIG. 22, respectively, taken along Y-Y line indicated in (c) of FIG. 22. Part (f) of FIG. 22 is a sectional view showing the bearing member 20 when the bearing member 20 is cut along the Y-Y line in (c) of FIG. 22.

The bearing member 20 includes a contact portion-forming portion 20*a* where the contact surface 19*a* of the contact portion 19 is to be molded and a cone metal supporting portion-forming portion 20*b* where the core metal supporting portion 19*b* is to be molded. Further, the bearing member 20 includes a mold contact surface 20*d* to which a mold 27 is to be contacted when the contact portion 19 is molded and a mold contact surface 20*e* to which a mold 28 is to be contacted. The core metal supporting portion-forming portion 20*b* has a shape such that it is recessed from the mold contact surface 20*e* with the mold 28 (FIG. 24) with respect to the longitudinal direction of the process cartridge B (toward a side opposite to an arrow N direction in (f) of FIG. 22). The bearing member 20 has a tunnel shape 20*c*. An inner space of the tunnel shape 20*c* is a through hole provided in a wall portion having end surfaces 20*f* and 20*g* ((f) of FIG. 22) of the contact portion-forming portion 20*a* and the core metal supporting portion-forming portion 20*b*, respectively.

Further, as shown in (f) of FIG. 22, end portions (end surfaces) corresponding to an entrance and exit of the tunnel shape 20*c* are provided with tapered portions 20*h* and 20*i*, respectively. Incidentally, a surface 20*f* is not present by providing the tapered portion 20*i* and constitutes a phantom surface. However, a size of the tapered portion 20*i* is not but the tapered portion 20*i* may also be provided while leaving the surface 20*f*.

(Contact Surface Forming Mold)

With reference to FIGS. 21 and 23, the mold 27 for forming the contact surface 19*a* of the contact portion 19 will be described. FIG. 23 is a perspective view showing the mold 27, which is one of the two molds to be contacted to the bearing member 20, used when the contact surface 19*a* of the contact portion 19 is formed.

The mold 27 for forming the contact surface 19*a* is provided with a contact surface 27*a* to be abutted against the bearing member 20 and a depression (recess) 27*b* where the contact surface 19*a* is to be molded. FIG. 23 shows the mold 27, as an example, configured to be capable of permitting formation of the contact surface 19*a* at three positions.

(Core Metal Supporting Portion Forming Mold)

With reference to FIGS. 21 and 24, the mold 28 for forming the core metal supporting portion 19*b* of the contact portion 19 will be described. FIG. 24 is a perspective view showing the mold 27, which is the other one of the two molds to be contacted to the bearing member 20, used when the core metal supporting portion 19*b* of the contact portion 19 is formed.

The mold 27 for forming the core metal supporting portion 19*b* is provided with a contact surface 28*a* to be abutted against the bearing member 20, a projection 28*b* for permitting molding of an inner diameter portion of the core metal supporting portion 19*b*, and an inject port 28*c* into which a gate 30 for injection of an electroconductive resin material is to be inserted. FIG. 24 shows the mold 27, as an example, configured to be capable of permitting formation of the core metal supporting portion 19*b* at three positions.

(Contact Portion Forming Method)

A forming method of the contact surface 19*a* and the core metal supporting portion 19*b* will be described with reference to FIGS. 21 to 26, 32 and 33. Parts (a) to (c) of FIG. 32 are schematic sectional views showing an operation of injection of the electroconductive resin material from the contact of the molds 27 and 28 with the bearing member 20 to completion of the injection in a time-series manner. Parts (a) to (d) of FIG. 25 are schematic perspective views showing a state until the molds 27 and 28 are contacted to the bearing member 20 in a time-series manner.

First, as shown in (a) of FIG. 25, the mold 28 is contacted to the bearing member 20 (in an arrow direction in the figure). At this time, the contact surface 28*a* of the mold 28 is abutted against the contact surface 20*e* of the bearing member 20.

Next, as shown in (b) of FIG. 25, the mold 27 is contacted to the bearing member 20 (in an arrow direction in the figure). At this time, the contact surface 27*a* of the mold 27 is abutted against the contact surface 20*d* of the bearing member 20. A state in which the two molds 27 and 28 are contacted to the bearing member 20 to sandwich the bearing member 20 therebetween is (c) of FIG. 25.

At this time, as shown in (a) of FIG. 32, a spacing between the mold 27 and an outer peripheral surface of the tunnel shape 20*c* and a spacing between the mold 27 and the tunnel shape 20*c* with respect to the longitudinal direction of the process cartridge constitute the contact portion-forming portion 20*a*. Further, a spacing between the projection 28*b* of the mold 28 and the bearing member 20 constitutes the core metal supporting portion-forming portion 20*b*.

Next, as shown in (a) of FIG. 32 and (d) of FIG. 25, the gate 30 for permitting the injection of the electroconductive resin material 34 is inserted into the inject port 28*c* of the mold 28 (in an arrow direction in (d) of FIG. 25) after the molds 27 and 28 are contacted to the bearing member 20, thus being abutted against a rear end of the inject port 28*c*. In this case, the gate 30 and the mold 28 may also be integrally molded originally.

Thereafter, as shown in (b) of FIG. 32, the electroconductive resin material 34 is injected from the gate 30 into the core metal supporting portion-forming portion 28*b* via the injection port 28*c*.

Then, the electroconductive resin material 34 passes through the inner space of the tunnel shape 20*c* of the bearing member 20 to reach the electroconductive resin material 34. The electroconductive resin material 34 flowing out from the tunnel shape 20*c* enters the contact portion-forming portion 20*a* to fill the spacing between the mold 27 and the tunnel shape 20*c* including the tapered portion 19*g*.

When the injection is completed, mold opening is made. Thus, the electroconductive resin material 34 is integrally molded with the bearing member 20, so that the bearing F is prepared.

In the thus-prepared bearing F, as shown in FIGS. 26, 32 and 33, the electroconductive resin material entering the contact portion-forming portion 20*a* forms the contact surface 19*a*, and the electroconductive resin material entering the core metal supporting portion-forming portion 20*b* forms the core metal supporting portion 19*b*.

An inner diameter surface of the core metal supporting portion 19*b* rotatably supports the core metal end portion 12*b* of the developing roller 12 when the developing roller 12 is assembled. Further, the end surface of the core metal supporting portion 19*b* and the inner diameter surface of the core metal supporting portion 19*b* constitute the contact portion for electrically connecting the developing roller 12 and the contact portion 19. Thus, the contact surface 19*a* and the core metal supporting portion 19*b* are integrally molded with the bearing member 20 by passing the electroconductive resin material 34 through a flow passage (in the order of the gate 30, the injection port 28*c*, the core metal supporting portion-forming portion 20*b*, the inner space of the tunnel shape 20*c* and the contact portion-forming portion 20*a*) to be molded. A resin material portion molded by being penetrated through the inner space (through hole) of the tunnel shape 20*c* corresponds to a penetration portion of the electrode member.

Although described later, in the case where the higher degree of accuracy is required, compared with a constitution in which a different material is injected later, two-color molding is preferable since it is performed without taking out a molded product from the mold. The two-color molding is a molding method in which a first color resin material (for the bearing member 20 in this embodiment) is injected and molded and thereafter a second color resin material (corresponding to the electrode member 34 in this embodiment) is injected and molded without taking out the molded product of the first color resin material from the mold, and then a resultant molded product is parted from the mold.

Part (c) of FIG. 32 is a perspective view showing a state in which the injection of the electroconductive resin material 34 is completed.

Next, the parting will be described.

Parts (a) to (d) of FIG. 26 are perspective views for illustrating an operation of the parting after the injection of the resin material for forming the bearing F is completed, in a time-series manner.

First, as shown in (a) of FIG. 26, the gate 30 is retracted from the injection part 28*c* of the mold 28 (in an arrow direction in the figure). Part (b) of FIG. 26 shows a state in which the gate 30 is retracted. Next, as shown in (c) of FIG. 26, the mold 27 is parted from the bearing member 20 (in an arrow direction in the figure). Finally, as shown in (d) of FIG. 26, the mold 28 is parted from the bearing member 20 (in an arrow direction in the figure). As a result, a state in which the contact portion 19 (including the contact surface 19*a* and the core metal supporting portion 19*b*) is integrally formed with the bearing member 20 is formed.

(Functions and Retaining of Shapes of Contact Portion, Prevention of Jerky Between Parts and Center Alignment Between Two Members)

Next, with reference to FIGS. 32, 27 and 33, retaining (anchor shape) of the molded contact portion 19 and center alignment between two members will be described. Part (a) of FIG. 35 is a schematic sectional view for illustrating a general structure of the bearing member 20 and the contact portion 19. Part (b) of FIG. 35 is a partly enlarged view showing the tapered portion 20*i* (19*h*) shown in (a) of FIG. 35, and illustrates forces acting on the tapered portion 20*i* (19*h*) during molding. Parts (a) and (d) of FIG. 27 are perspective views for illustrating functions of the contact portion 19 after the mold is parted from the contact portion 19 and the molding of the contact portion 19 is completed. In these figures, the bearing member 20 is not illustrated.

As shown in (a) and (b) of FIG. 27, the contact portion 19 includes the contact surface 19*a*, the core metal supporting portion 19*b* and the buffer portion 32. Further, as shown in (c) and (d) of FIG. 27, when the process cartridge B is mounted in the main assembly of the image forming apparatus A, the in assembly electrode 21 is contacted to the contact surface 19*a*. When the developing roller 12 is assembled, the core metal end portion 12*b* of the developing roller 12 is contacted to the core metal supporting portion 19*b*, so that the core metal end portion 12*b* is rotatably supported by the core metal supporting portion 19*b*.

By such a constitution, a conduction path from the main assembly electrode 21 to the core metal end portion 12*b* of the developing roller 12.

The reason why such a constitution is employed is that the bearing member 20 and the contact portion 19 are formed of different materials having no compatibility (affinity) and therefore there is a possibility that they do not intimately contact each other to cause floating and dropping-off.

Further, as shown in (f) of FIG. 22 and (f) of FIG. 33, at the contact portion 19, a rear-side surface diameter 19*d* of the contact surface 19*a* and a rear-side surface diameter 19*e* of the core metal supporting portion 19*b* are larger than an inner diameter 19*c* of the tunnel shape 20*c*. As a result, even when a force is applied to the contact portion 19 in an arrow N direction in (f) of FIG. 22, the surface with the surface diameter 19*d* is contacted to a surface 20*g* of the bearing member 20 and the surface with the surface diameter 19*e* is contacted to a surface 20*f* of the bearing member. This is also true for opposite direction. For this reason, it is possible to prevent the floating and dropping-off of the contact portion from the bearing member 20.

Thus, by forming the contact portion 19 so as to sandwich the portions of the bearing member 20, even in the case where impact is applied to the process cartridge B during transportation or the like, it is possible to prevent the contact portion 19 from being dropped off from the bearing member 20 and from being floated from the bearing member 20.

In this embodiment, the contact portion 19 is molded to block end portion holes (through hole) of the tunnel shape 20*c* but is not limited thereto so long as the contact portion 19 is constituted to prevent the floating and dropping-off thereof from the bearing member 20. For example, an anchor portion (flange portion or projection) projected toward the outer diameter side from the end portion holes (through hole) of the tunnel shape 20*c* may preferably be provided so as to sandwich the portion (the wall surface with the end surfaces 20*f* and 20*g*) of the bearing member 20.

In the case where the contact portion 19 has a planar configuration with no anchor shape, when a force is applied in one direction, there is a possibility that the contact portion 19 is dropped off from the bearing member 20. For that reason, as described above, by providing the contact portion 19 with a three-dimensional structure, even when the force is applied in any direction, the contact portion 19 can perform a retaining function capable of preventing the jerky (floating) and the dropping-off.

In this embodiment, a high-impact polystyrene resin material with a shrinkage rate of 0.6% is used as the resin material for the bearing member 20, and an electroconductive polyacetal resin material with the shrinkage rate of 1.2% is used as the electroconductive resin material 34.

Then, in this embodiment, the molding of the contact portion 19 is made by injecting the electroconductive resin material 34 after the molding of the bearing member 20, thus integrally molding the resin material for the bearing member 20 and the electroconductive resin material 34. Particularly, in this embodiment, during the molding of the contact portion 19, the electroconductive resin material 34 is injected before the (melted) resin material for molding the bearing member 20 is completely cooled to be solidified, so that the electroconductive resin material 34 is integrally molded with the resin material for the bearing member 20 to prepare the bearing F.

For this reason, based on a difference in shrinkage rate (a larger shrinkage rate of the resin material injected later), the electroconductive resin material 34 sandwiches and clamps the bearing member 20.

In such a constitution in which the bearing member is sandwiched by the electroconductive resin material 34 based on the shrinkage of the electroconductive resin material 34 after the molding, the contact portion is not readily disconnected from the bearing member 20. That is, the contact surface 19*a* and the core metal supporting portion 19*b* which sandwich the bearing member 20 (the wall surface with the end surfaces 20*g* and 20*f*) are shrunk in F1 and F2 directions indicated by arrows in (f) of FIG. 33 and therefore the contact portion 19 is satisfactorily connected to the bearing member 20, thus being not readily disconnected form the bearing member 20.

Thus, in this embodiment, the constitution in which the electroconductive resin material 34 is injected into the bearing member 20 to mold the contact portion 19 integrally with the bearing member 20 is employed and therefore compared with a constitution in which parts are assembled with each other, it is possible to more prevent the jerky between the parts.

In this embodiment, as the resin material for the contact portion 19, a polyacetal resin material containing carbon black in an amount of about 10% is used. By the use of carbon black, damage (abrasion or the like) on a manufacturing device can be minimized. So long as the damage on the manufacturing device can be minimized, the additive is not limited to carbon black but may also be carbon fibers, other metal-based additives, and the like.

Next, with reference to FIGS. 35, 22 and 33, the center alignment between the bearing member 20 and the core metal supporting portion 19*b* will be described.

As shown in FIG. 35 and (f) of FIG. 22, the end portions corresponding to the entrance and exit of the tunnel shape 20*c* are provided with the tapered portions 20*h* and 20*i*, respectively. These tapered portions are provided, at the end portions of an inner space (through hole) of the tunnel shape 20*c* with respect to a penetration direction (axial direction) of the inner wall, so as to be increased in diameter from the center of the tunnel shape 20*c* (wall portion) toward the outside with respect to a direction crossing the axial direction).

Further, these tapered portions 20*h* and 20*i* are provided so that their tops (tops of phantom cones including inclined surfaces constituting the tapered portions) are located on a center (axis) line of the core metal supporting portion 19*b* (indicated by a chain line H in FIG. 35). The chain line H shown in FIG. 35 corresponds to a rotational axis of the developing roller 12 supported by the core metal supporting portion 19*b*, so that the tops of the tapered portions 20*h* and 20*i* are located on the rotational axis of the developing roller 12.

When the contact portion 19 is molded in (on) the bearing member 20, tapered portions 19*g* and 19*h* are molded at positions where they opposes the tapered portions 20*h* and 20*i*, respectively. The tapered portions 19*g* and 19*h* correspond to taper-like contact portions.

The contact portion 19 is shrunk toward the center of a molded product after the molding (when the resin material is solidified) and therefore a peripheral portion of the core metal supporting portion 19*b* is shrunk in the F1 direction shown in FIG. 35 and the contact surface 19*a* is shrunk in the F2 direction. In other words, when the electroconductive resin material 34 is solidified during the molding, the electroconductive resin material 34 at the peripheral portions of the end portions of the tunnel shape 20*c* are shrunk toward the center of the tunnel shape 20*c* (penetration portion) in the penetration direction.

In this case, as shown in (b) of FIG. 35, a shrinking force in the F1 direction is divided into component forces in F11 and F12 directions by the tapered portion 20*i*. By the component force in the F11 direction, a center of the outer diameter of the core metal supporting portion 19*b* is aligned with a center of an inner diameter of the core metal supporting portion-forming portion 20*b*.

Thus, by providing the tapered portion 20*i*, the center alignment between the outer diameter center (corresponding to the rotational axis of the developing roller 12) of the core metal supporting portion 19*b* and the bearing member 20 (the inner diameter center of the core metal supporting portion-forming portion 20*b*) can be effected. Therefore, positional accuracy of the core metal supporting portion 19*b* (the rotational axis of the developing roller 12 or the contact portion 19) relative to the bearing member 20 can be enhanced (improved).

By the forces (during shrinkage of the contact portion 19 when the resin material is solidified after the molding) applied in the F1 and F2 directions, the bearing member 20 is sandwiched between the contact surface 19*a* and the core metal supporting portion 19*b* and thus can be clamped by the contact portion 19.

During the molding, by the injection of the electroconductive resin material 34, the tapered portions 19*g* and 19*h* of the contact portion 19 are molded in a contact state with the tapered portions 20*h* and 20*i*. However, also after the resin material is molded and shrunk to be solidified, the contact state is maintained. That is, before and after the solidification of the electroconductive resin material 34, the contact state of the tapered portions 19*g* and 19*h* with the tapered portions 20*h* and 20*i* is maintained.

As a result, in the state in which the electroconductive resin material 34 after being molded is shrunk and solidified, the tapered portions 19*g* and 19*h* are contacted to the tapered portions 20*h* and 20*i*, so that the contact portion 19 can be fixed (positioned) to the bearing member 20 with reliability.

Thus, by the forces of the contact portion, during the shrinkage after the molding, applied in the F1 and F2 directions, it is possible to prevent the jerky or the like caused by the shrinkage of the resin material after the molding. Therefore, the positional accuracy of the core metal supporting portion 19*b* (contact portion 19) relative to the bearing member 20 can be further enhanced and it is possible to suppress a positional fluctuation of the core metal supporting portion 19*b* relative to the bearing member 20.

In this embodiment, the tapered portions 20*h* and 20*i* are provided at the end portions corresponding to the entrance and exit of the tunnel shape 20*c*. However, the tapered portion may also be provided only at one end portion as desired and may only be required to be provided at at least either one of the end portions.

In the case where only the tapered portion 20*i* is provided, the center alignment can be effected as described above, and in the state in which the electroconductive resin material 34 after being molded is shrunk and solidified, the tapered portion 20*i* and the tapered portion 19*h* can be placed in the contact state. As a result, the positional accuracy of the core metal supporting portion 19*b* (the contact portion 19) relative to the bearing member 20 can be further enhanced.

Further, in the case where only the tapered portion 20*h* is provided, in the state in which the electroconductive resin material 34 after being molded is shrunk and solidified, the tapered portion 20*h* and the tapered portion 19*i* can be placed in the contact state. Also in this case, the positional accuracy of the core metal supporting portion 19*b* (the contact portion 19) relative to the bearing member 20 can be further enhanced.

Further, in this embodiment, the tapered portions 20*h* and 20*i* are provided so that their tops are located on the center axis of the core metal supporting portion 19*b* (on the chain line H shown in FIG. 35) but the present invention is not limited thereto. In the case where an effect of preventing the jerky or the like, caused by the shrinkage of the resin material after the molding, by placing the tapered portions of the bearing member 20 and the contact portion 19 in the contact state, the tops of the tapered portions 20*h* and 20*i* may also not be located on the center axis of the core metal supporting portion 19*b*.

Further, the tops of the tapered portions 20*h* and 20*i* may only be required to be located on the center axis of the core metal supporting portion 19*b* and may also not coincide with the center of the inner space of the tunnel shape 20*c* (the center of the tunnel shape 20*c* with respect to a direction perpendicular to the chain line H shown in (a) of FIG. 35).

(Clamping and Back-Up)

Clamping performed in a step of forming the contact surface 19*a* and the core metal supporting portion 19*b* will be described with reference to Figures (c) of FIG. 25 and FIG. 28.

Part (c) of FIG. 25 is a schematic perspective view showing a state in which the bearing member 20 is clamped by bringing the molds 27 and 28 into contact with the bearing member 20. FIG. 28 is a schematic sectional view for illustrating resin pressure.

When the contact portion 19 is molded, the contact surface 27*a* of the mold 27 is contacted to the mold contact surface 20*d* of the bearing member 20 to perform the clamping. Further, the contact surface 28*a* of the mold 28 is contacted to the mold contact surface 20*e* of the bearing member 20 to perform the clamping.

In this embodiment, during the mold clamping, the bearing member 20 is sandwiched between the molds 27 and 28, so that the mold contact surfaces 20*d* and 20*e* of the bearing member 20 are supported by the molds 27 and 28, respectively. This is because the mold contact surfaces 20*d* and 20*e* of the bearing member 20, the contact surface 27*a* of the mold 27 and the contact surface 28*a* of the mold 28 are not moved (deviated) by and the bearing member 20 is not deformed by urging forces of the molds 27 and 28 and resin pressure P during the resin material injection.

In this embodiment, during the mold clamping, the mold contact surfaces 20*d* and 20*e* are supported but supporting portions are not limited thereto. That is, the supporting portions may be a portion where the movement and deformation of the bearing member 20 can be suppressed by supporting the bearing member 20.

(Two-Color Molding)

Next, the above-described two-color molding will be described specifically with reference to (a) to (d) of FIG. 29.

Parts (a) to (d) of FIG. 29 are schematic sectional views for illustrating the case where the bearing F having a simple shape is manufactured by the two-color molding by using molds 22, 23 and 25 for a first color and molds 23, 24 and 25 for a second color. Part (a) of FIG. 29 shows a state of connection of the molds 22, 23 and 25. Part (b) of FIG. 29 shows a state in which the first color resin material (for the bearing member 20) is molded. Part (c) of FIG. 29 shows a state in which the mold 22 is replaced with the mold 24. Part (d) of FIG. 29 shows a state in which the second color resin material (for the contact portion 19) is molded.

In the two-color molding, first, as shown in (a) of FIG. 29, the molds 22, 23 and 25 are connected for molding the first color resin material for the bearing member 20, thus forming a resin material injection space. Then, as shown in (b) of FIG. 29, the resin material for the bearing member 20 is injected into the space in the molds, thus being molded as the bearing member 20. Next, as shown in (c) of FIG. 29, the mold 22 is replaced with the mold 24, and the mold 25 is retracted in an arrow direction in a distance corresponding to a thickness of the contact surface 19*aa* to be formed, thus forming a space into which the electroconductive resin material 34 is to be injected. Finally, as shown in (d) of FIG. 29, the electroconductive resin material 34 is injected from the injection port 24*a* of the mold 24 into the space, thus being molded as the contact portion 19.

By using the two-color molding, the injection pressure can be increased and thus by the increase in injection pressure, the contact portion 29 can be shaped with high accuracy. Further, in this embodiment, during the molding, the center alignment is effected between the tapered portion 20*i* provided on the bearing member 20 and the tapered portion 19*h* provided on the contact portion 19 and therefore in a state in which a degree of the positional accuracy of the contact portion 19 is higher, the contact portion 19 is molded integrally with the bearing member 20.

Next, with reference to FIGS. 29 and 30, the contact portion 19 and the bearing member 20 which are molded by the two-color molding will be described.

Part (a) of FIG. 30 is a perspective view showing an outer appearance of the contact portion 19 and the bearing member 20 which are integrally molded by the two-color molding described with reference to FIG. 29. Part (B) of FIG. 30 is a plan view showing the integrally molded contact portion 19 and bearing member 20. Part (c) of FIG. 30 is a schematic sectional view of the contact portion 19 and the bearing member 20 taken along V-V line indicated in (b) of FIG. 30.

Also in the molding method in this case, the electroconductive resin material 34 is configured to sandwich the bearing member 20 between the contact surface 19*a* and the core metal supporting portion 19*b*. That is, as shown in (c) of FIG. 30, the contact surface 19*a* and the core metal supporting portion 19*b* between which the bearing member 20 is sandwiched as shrunk in F1 and F2 directions indicated by arrows in the figure. For this reason, the contact portion 19 clamps (fastens) the bearing member 20. As a result, the contact portion 19 and the bearing member 20 are fixed firmly, so that it is possible to prevent the floating and the dropping-off which can occur between the contact portion 19 and the bearing member 20.

Further, the tunnel shape 20*c* is provided with the tapered portions 20*h* and 20*i* at its end portions and therefore as described above, the positional accuracy of the core metal supporting portion 19*b* of the contact portion 19 relative to the bearing member 20 can be further enhanced. As described above, the constitution in which the tapered portion 20*i* is provided in the core metal supporting portion 19*b* side may also be employed.

As described above, according to Embodiment 2, the center alignment between the bearing member 20 and the core metal supporting portion 19*b* can be effected, so that the positional accuracy of the contact portion 19 relative to the bearing member 20 can be further enhanced.

Further, the tunnel shape 20*c* is provided with the tapered portions 20*h* and 20*i* at its end portions, and the contact portion 19 is provided with the tapered portions 19*g* and 19*h* kept in the contact state with the tapered portions 20*h* and 20*i* before and after the solidification of the resin material during the molding. As a result, the jerky or the like by the shrinkage of the resin material after the molding can be prevented. Therefore, the positional accuracy of the core metal supporting portion 19*b* (contact portion 19) relative to the bearing member 20 can be further enhanced, and it is possible to suppress, a positional fluctuation of the core metal supporting portion 19*b* relative to the bearing member 20.

Further, the contact portion 19 is formed to sandwich the bearing member 20.

As a result, even when impact is applied to the process cartridge during transportation or the like, by the anchor shape, it is possible to prevent generation of phenomena such that the contact portion 19 is dropped off from the bearing member 20 and such that the contact portion 19 is floated from the bearing member 20.

Here, the contact portion 19 in this embodiment electrically connects each of the developing roller 12 and the toner supplying roller 16 with the main assembly electrode 21 in the developing cartridge C but the present invention is not limited thereto. The contact portion 19 may also electrically connect, e.g., the photosensitive drum 7 and the main assembly of image forming apparatus A in the drum cartridge D. Further, the contact portion 19 may also be provided correspondingly to each of the photosensitive drum 7 and the charging roller 18. That is, the contact portion for electrically connecting the charging roller 18 and the main assembly of the image forming apparatus A, and the contact portion for electrically connecting the photosensitive drum 7 and the main assembly of the image forming apparatus A may also be provided. Further, in the case where the present invention is applied to the process cartridge B as described above, the contact portion may also be provided in a plurality of electrode portions correspondingly to the photosensitive drum 7 and the plurality of recording material. Further, in this embodiment, as a structure for supporting the core metals of the developing roller 12 and the toner supplying roller 16, the core metal supporting portion 19*b* of the contact portion 19 is described but the present invention is not limited thereto. Any portion for supporting a slidable (rotatable) member may also be used. Further, in this embodiment, the contact portion 19 is provided in (on) the bearing member 20 but a constitution in which the contact portion 19 is provided on the developing cartridge frame 9, and the developing roller 12 and the toner supplying roller 16 are supported by the developing cartridge frame 8 may also be employed.

Further, in this embodiment, the constitution in which the contact portion 19 is provided with the core metal supporting portion 19*b* for being contacted to rotatable members such as the developing roller 12 and the toner supplying roller 16 which are the process means was described. However, the contact portion may also electrically connecting a constituent member, other than the rotatable members, with the main assembly of the image forming apparatus A. An example thereof will be described with reference to FIG. 34.

Parts (a) to (c) of FIG. 34 are schematic views showing a process means, other than the rotatable members, contactable to the contact portion. In these figures, the developing blade 11 contacts, at a developing blade end surface 11*a*, a developing blade contact portion 31 provided on the bearing F (bearing member 20). Further, at the end portions of the tunnel shape, the tapered portion is not provided. By employing such a constitution, also to the process means other than the rotatable members, the positional accuracy of the contact portion can be further enhanced and the voltage can be applied.

A developing cartridge in Embodiment 1 will be described. The image forming apparatus in this embodiment is the same as that in Embodiment 1, thus being omitted from description. Similarly, the cross-sectional shape of the developing cartridge in this embodiment is the same as that in Embodiment 1 and therefore (b) of FIG. 12 is also referred to in this embodiment.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 245734/2011 filed Nov. 9, 2011 and 277466/2011 filed Dec. 19, 2011, which are hereby incorporated by reference.

What is claimed is:

1. A cartridge detachably mountable to a main assembly of an image forming apparatus, said cartridge comprising:

a rotatable member to be electronically connected with a contact of the main assembly;

a frame; and an electrode member formed on said frame by injection molding of an electroconductive resin material, said electrode member working a bearing member and constituting a conducting path between the contact and said rotatable member when said cartridge is mounted to the main assembly.

2. A cartridge according to claim 1, wherein said electrode member includes a supporting portion that is configured to support said rotatable member, and an electrical contact that is connected with the contact of the main assembly.

3. A cartridge according to claim 2, wherein said frame includes a through hole, and said electrode member includes a penetrating portion for penetrating through said through hole, and wherein said penetrating portion is configured to be positioned between said support member and said electrical contact.

4. A cartridge according to claim 3, wherein said electrical contact is regulated from moving relative to said frame in the direction that said penetrating portion penetrates said through hole.

5. A cartridge according to claim 3, wherein said supporting portion is regulated from moving relative to said frame in the direction that said penetrating portion penetrates said through hole.

6. A cartridge according to claim 3, wherein said electrode member includes an engaging portion that is provided in an end side of said penetrating portion with respect to the direction that said penetrating portion penetrates said through hole and which extends in a direction crossing the penetrating direction, and wherein at least one of said supporting portion and said engaging portion has a tapered portion inclined from a surface perpendicular to the penetrating direction.

7. A cartridge according to claim 6, wherein a vertex of a phantom circular cone including said tapered portion is located on a rotational axis of a member to be electrically connected that is supported by said electrode member.

8. A cartridge according to claim 1, wherein said rotatable member is a developing roller for developing an electrostatic latent image formed on a photosensitive member.

9. A cartridge according to claim 1, wherein said rotatable member is a supplying roller for supplying developer to a developing roller for developing an electrostatic latent image formed on a photosensitive member.

10. A cartridge according to claim 1, wherein said electrode member includes a recessed portion, and an end portion of said rotatable member is inserted into said recessed portion to rotatably support said rotatable member.

11. A cartridge according to claim 1, wherein said electrode member includes a projected portion, and said projected portion is inserted into a recessed portion provided on a longitudinal end surface of said rotatable member to rotatably support said rotatable member.

12. An image forming apparatus for forming an image on a recording material, said image forming apparatus comprising:

(i) a main assembly electric contact;

(ii) a cartridge including:

(a) a rotatable member to be electrically connected with a contact of said main assembly electric contact;

(b) a frame; and (c) an electrode member formed on said frame by injection molding of an electroconductive resin material, said electrode member working a bearing member and constituting a conducting path between said main assembly electric contact and said rotatable member when said cartridge is mounted to a main assembly of said image forming apparatus; and (iii) conveying means for conveying the recording material.

13. An image forming apparatus according to claim 12, wherein said electrode member includes a supporting portion that is configured to support said rotatable member, and an electrical contact that is connected with the contact of the main assembly.

14. An image forming apparatus according to claim 13, wherein said frame includes a through hole, and said electrode member includes a penetrating portion for penetrating through said through hole, and wherein said penetrating portion is configured to be positioned between said supporting portion and said electrical contact.

15. An image forming apparatus according to claim 14, wherein said electrical contact is regulated from moving relative to said frame in the direction that said penetrating portion penetrates said through hole.

16. An image forming apparatus according to claim 14, wherein said supporting portion is regulated from moving relative to said frame in the direction that said penetrating portion penetrates said through hole.

17. An image forming apparatus according to claim 13, wherein said electrode member includes an engaging portion that is provided in an end side of said penetrating portion with respect to the direction that said penetrating portion penetrates said through hole and which extends in a direction crossing the penetrating direction, and wherein at least one of said supporting portion and said engaging portion has a tapered portion inclined from a surface perpendicular to the penetrating direction.

18. An image forming apparatus according to claim 17, wherein a vertex of a phantom circular cone including said tapered portion is located on a rotational axis of a member to be electrically connected that is supported by said electrode member.

19. An image forming apparatus according to claim 12, wherein said rotatable member is developing roller for developing an electrostatic latent image formed on a photosensitive member.

20. An image forming apparatus according to claim 12, wherein said rotatable member is a supplying roller for supplying developer to a developing roller for developing an electrostatic latent image formed on a photosensitive member.

21. An image forming apparatus according to claim 12, wherein said electrode member includes a recessed portion, and an end portion of said rotatable member is inserted into said recessed portion to rotatably support said rotatable member.

22. An image forming apparatus according to claim 12, wherein said electrode member includes a projected portion, and said projected portion is inserted into a recessed portion provided on a longitudinal end surface of said rotatable member to rotatably support said rotatable member.

23. A bearing member supporting a rotatable member to be electrically connected with a main assembly of the image forming apparatus, said bearing member comprising:

a frame; and an electrode member formed on said frame by injection molding of an electroconductive resin material, said electrode member working a bearing member and constituting a conducting path when said bearing member is mounted to the main assembly.

24. A bearing member according to claim 23, wherein said electrode member includes a (i) supporting portion that is configured to support the rotatable member, (ii) an electrical contact that is connected with the contact of the main assembly, and (iii) an engaging portion, wherein at least one of said supporting portion and said engaging portion has a tapered portion inclined from a surface perpendicular to the penetrating direction.

25. A bearing member according to claim 24, wherein said frame includes a through hole, and said electrode member includes a penetrating portion for penetrating through said through hole, and wherein said penetrating portion is configured to be positioned between said supporting portion and said electrical contact.

26. A bearing member according to claim 25, wherein said electrical contact is regulated from moving relative to said frame in the direction that said penetrating portion penetrates said through hole.

27. A bearing member according to claim 25, wherein said supporting portion is regulated from moving relative to said frame in the direction that said penetrating portion penetrates said through hole.

28. A bearing member according to claim 25, wherein at least one of said supporting portion and said engaging portion has a tapered portion inclined from a surface perpendicular to the direction that said penetrating portion penetrates said through hole.

29. A bearing member according to claim 28, wherein a vertex of a phantom circular cone including said tapered portion is located on a rotational axis of a member to be electrically connected that is supported by said electrode member.

30. A bearing member according to claim 23, wherein the rotatable member is a developing roller for developing an electrostatic latent image formed on a photosensitive member.

31. A bearing member according to claim 23, wherein the rotatable member is a supplying roller for supplying a developer to a developing roller for developing an electrostatic latent image formed on a photosensitive member.

32. A bearing member according to claim 23, wherein said electrode member includes a recessed portion, and an end portion of the rotatable member is inserted into said recessed portion to rotatably support the rotatable member.

33. A bearing member according to claim 23, wherein said electrode member includes a projected portion, and said projected portion is inserted into a recessed portion provided on a longitudinal end surface of the rotatable member to rotatably support the rotatable member.

* * * * *